US007867681B2

(12) United States Patent
Yoshida et al.

(10) Patent No.: US 7,867,681 B2
(45) Date of Patent: Jan. 11, 2011

(54) ELECTROSTATIC IMAGE DEVELOPING TONER, ELECTROSTATIC IMAGE DEVELOPER, TONER CARTRIDGE, PROCESS CARTRIDGE, AND IMAGE FORMING APPARATUS

(75) Inventors: Satoshi Yoshida, Kanagawa (JP); Shinpei Takagi, Kanagawa (JP); Noriyuki Mizutani, Kanagawa (JP); Yusuke Ikeda, Kanagawa (JP); Katsumi Daimon, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 218 days.

(21) Appl. No.: 11/905,473

(22) Filed: Oct. 1, 2007

(65) Prior Publication Data

US 2008/0187854 A1 Aug. 7, 2008

(30) Foreign Application Priority Data

Feb. 1, 2007 (JP) ..... 2007-023395

(51) Int. Cl.
*G03G 9/087* (2006.01)

(52) U.S. Cl. ..... 430/109.4; 430/109.1; 399/159

(58) Field of Classification Search ..... 430/109.1, 430/109.4; 399/159
See application file for complete search history.

(56) References Cited

U.S. PATENT DOCUMENTS

2003/0054280 A1* 3/2003 Ishihara et al. ..... 430/124
2005/0117919 A1* 6/2005 Ito et al. ..... 399/27
2006/0216628 A1 9/2006 Nakamura et al.
2006/0292476 A1* 12/2006 Maehata et al. ..... 430/109.4

FOREIGN PATENT DOCUMENTS

| | | |
|---|---|---|
| JP | A-64-035454 | 2/1989 |
| JP | A-2003-186250 | 7/2003 |
| JP | A-2004-133320 | 4/2004 |
| JP | A-2004-191927 | 7/2004 |
| JP | 2004-287269 | * 10/2004 |
| JP | A-2004-287269 | 10/2004 |
| JP | A-2006-171692 | 6/2006 |
| JP | A-2006-267231 | 10/2006 |
| JP | A-2006-267741 | 10/2006 |
| JP | A-2006-276064 | 10/2006 |
| JP | A-2007-033702 | 2/2007 |
| JP | A-2007-071993 | 3/2007 |
| JP | A-2007-279653 | 10/2007 |

OTHER PUBLICATIONS

English translation of JP 2004-287269 published Oct. 2004.*

* cited by examiner

*Primary Examiner*—Mark F Huff
*Assistant Examiner*—Peter L Vajda
(74) *Attorney, Agent, or Firm*—Oliff & Berridge, PLC

(57) ABSTRACT

An embodiment of the present invention provides an electrostatic image developing toner including a binder resin containing amorphous polyester resin containing a tin-containing catalyst and crystalline polyester resin containing a titanium-containing catalyst, and a colorant and a releasing agent, an electrostatic image developer using the same, a toner cartridge, a process cartridge, and an image forming apparatus.

3 Claims, 2 Drawing Sheets

ELECTROSTATIC IMAGE DEVELOPING TONER, ELECTROSTATIC IMAGE DEVELOPER, TONER CARTRIDGE, PROCESS CARTRIDGE, AND IMAGE FORMING APPARATUS

CROSS-REFERENCE TO RELATED APPLICATION

This application is based on and claims priority under 35 USC 119 from Japanese Patent Application No. 2007-23395 filed Feb. 1, 2007.

BACKGROUND (i) Technical Field

The present invention relates to an electrostatic image developing toner, an electrostatic image developer, a toner cartridge, a process cartridge, and an image forming apparatus.

(ii) Related Art

As an electrophotography process, various methods are known. In the electrophotography process, a latent image is electrically formed in various ways on a photoreceptor using a photoconductive material. The latent image is developed as a toner image using a toner. The toner image is transferred to an image receiving member, such as paper, optionally through an intermediate transfer member. Next, the toner image is fixed by heating, pressing, heating and pressing, solvent vapor or the like. A fixed image is formed through the plurality of processes. The toner that remains on the photoreceptor is cleaned by various methods. These processes are repeatedly performed.

In recent years, with the technical development in the electrophotography field, the electrophotography process is used for typography, as well as a copy machine and a printer. Then, copies having the same quality and colors as the printed matters are strongly demanded, together with high-speed processing and reliability of the apparatus. It is important for the toner to have high glossiness, high chromaticity, high stress resistance against high-speed processing, and long lifespan. Especially in recent years, energy saving is important. For example, in the electrophotography process, the amount of power consumed during a fixing process needs to be reduced.

As the binder resin, polyester resin is used in view of fixability improvement and storage ability. In recent years, styrene-acrylic copolymer resin is used in view of manufacturability of a polymerized toner. For a high gloss image, polyester resin has suitable melting characteristics.

To synthesize the polyester resin, an organic tin catalyst is widely used.

For the fixing condition, various conditions, such as the environment and the image receiving member to be used, are considered. A high-quality image having high glossiness and chromaticity is demanded even under a condition other than the general fixing condition. For example, when the temperature exceeds 30° C. and ten images or more are successively output using an OHP sheet during the summer, since the environmental temperature is high, the image receiving member (transparency) is insufficiently cooled. Further, since the image receiving member itself has large heat capacity, when successive copying is performed, a subsequently heated recording medium is discharged and stacked on a previously discharged recording medium before the image receiving member is cooled. For this reason, it may take several minutes until the toner image is solidified. In this period, since crystalline resin is crystallized at a relatively slow speed, chromaticity is degraded due to light scattering of the crystal, and image gloss may be degraded by the crystal domain. This phenomenon may occur when a recording medium having large heat capacity of the basis weight of 256 g/m$^2$ or more, such as resin-coated paper or cast-coated paper, is used, and successive output is performed at a slow output speed to improve image gloss (glossiness), as well as when the OHP sheet is used.

SUMMARY

According to an aspect of the present invention, there is provided an electrostatic image developing toner comprising a colorant, a releasing agent, and a binder resin containing an amorphous polyester resin containing a tin-containing catalyst and a crystalline polyester resin containing a titanium-containing catalyst.

BRIEF DESCRIPTION OF THE DRAWINGS

Exemplary embodiments of the present invention will be described in detail based on the following figures, wherein.

DETAILED DESCRIPTION

Figure 1:
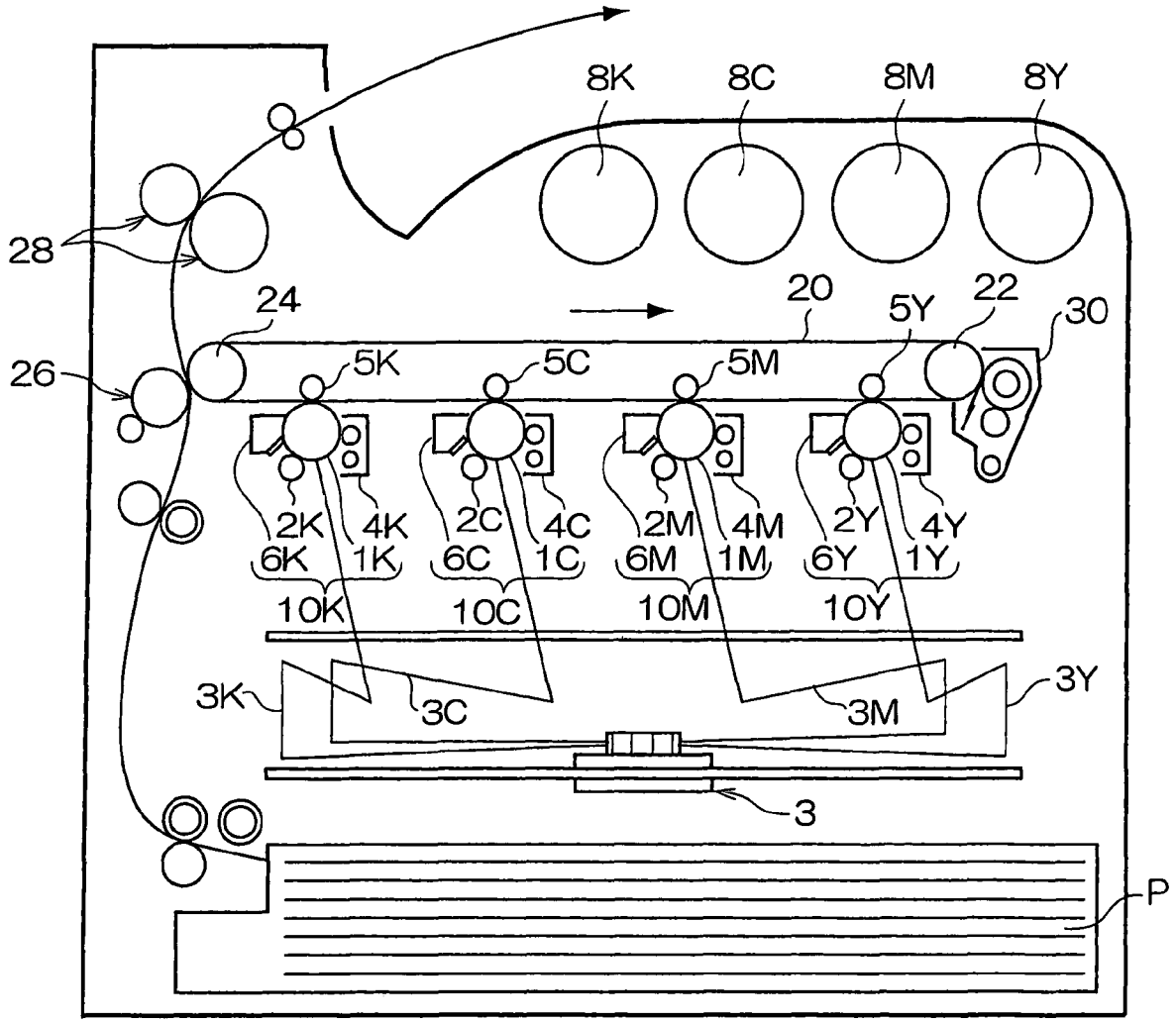
FIG. 1 is a diagram showing the schematic configuration of an image forming apparatus according to an exemplary embodiment of the invention.

Hereinafter, the present invention will be described in detail.

<Electrostatic Image Developing Toner>

An electrostatic image developing toner according to an exemplary embodiment of the invention (hereinafter, sometimes simply referred to as 'toner') includes at least a colorant, a releasing agent, and a binder resin containing an amorphous polyester resin containing a tin-containing catalyst and a crystalline polyester resin containing a titanium-containing catalyst.

As described above, when the crystalline resin is used in the binder resin is to improve low-temperature fixability (in the invention, low-temperature fixing unit that a toner is heated and solidified at a temperature lower than approximately 120° C.). However, it is known that, since the crystalline resin is only sharply molten with respect to the temperature, and has hysteresis between the melting temperature and the freezing temperature, it takes a lot of time until the crystalline resin is molten and then fixed. For this reason, an adverse condition to solidification may occur.

That is, if it takes a lot of time until the toner image is solidified after being fixed, since the crystalline resin is crystallized at a relatively slow speed, and then the crystal grows. As a result, chromaticity may be degraded due to light scattering of the crystal, and the image gloss may be degraded by the crystal domain. Specifically, this problem easily occurs when successive printing is performed using a recording medium having a large heat capacity under a high-temperature environment of about 30° C. or more.

The inventors have studied this problem in connection with the structure and compatibility of the polyester resin. As a factor for compatibility, a solubility parameter (hereinafter, sometimes referred to as 'SP value') is known. Accordingly, the inventors have noticed that the SP value of the crystalline polyester resin is smaller than the SP value of a general amorphous polyester resin used in the toner by approximately 10%, which is close to the SP value of a releasing agent, such as polyethylene, and have studied the melting and solidification behaviors of the crystalline polyester resin under the presence of a releasing agent.

As a result, the inventors have found that, if the crystalline polyester resin is present, (1) the endothermic peak temperature of the releasing agent falls in the differential scanning calorimetry (DSC), that is, the crystalline polyester resin and the releasing agent are compatible, and (2) the domain having the crystalline polyester resin and the releasing agent becomes large during the toner manufacturing process.

For this reason, the inventors have also found that, if the compatibility of the crystalline polyester resin and the amorphous polyester resin in the binder resin is not increased, it is not possible to reduce the size of the domain.

In regards to the compatibility of the crystalline polyester resin and the amorphous polyester resin, it is difficult to increase the compatibility of both resins due to the SP value. Meanwhile, an organic tin-containing catalyst that has been widely used for polymerization of polyester resin due to ease of synthesis may be partially gelled according to a polymerization condition, which may disturb the compatibility of the crystalline polyester resin and the amorphous polyester resin.

Accordingly, when a titanium-containing catalyst is used as a polymerization catalyst of polyester resin, it has been found that the domain having the releasing agent and the crystalline polyester resin is less likely to be large even under an adverse fixing condition with respect to the solidification.

The detailed reasons of the mechanism are not clear, but they may be guessed as follows. The titanium-containing catalyst is also used as an ester exchange catalyst during the polymerization of polyester resin. That is, the titanium-containing catalyst acts as a reaction catalyst and causes a decomposition reaction. Accordingly, when the titanium-containing catalyst remains in the polyester resin, the reaction occurs but slowly due to heat applied during a fusion step described below when a toner is manufactured. Therefore, ester exchange is performed at an interface of the amorphous polyester resin and the crystalline polyester resin, and thus compatibility at the interface is improved. It is considered that the compatibility of the crystalline polyester resin and the releasing agent is decreased by the amount of compatibility of the crystalline polyester resin and the amorphous polyester resin, and the domain becomes small.

Further, since titanium is likely to have a hydrophilic property so as to be used in a photo catalyst compared with tin, aggregation or fusion characteristics may change in a process of manufacturing a toner.

However, when the titanium-containing catalyst is used in the crystalline polyester resin and the amorphous polyester resin, the compatibility is further improved, but the crystalline polyester resin is likely to be exposed from the surface of the toner, or the glass transition temperature of bulk resin may be decreased.

The inventors have further studied and have found that, if a titanium-containing catalyst is only used for polymerization of crystalline polyester resin, and a material polymerized by a tin-containing catalyst is combined as amorphous polyester resin, the domain of crystalline polyester resin of the toner can be made small even under the adverse condition to solidification, without causing the above-described problems.

The detailed particulars of a mechanism, through which the above-described characteristics are obtained, are not clear, but it may be guessed that, since the tin-containing catalyst is used in the amorphous polyester resin, appropriate compatibility with the crystalline polyester resin is maintained. Meanwhile, when amorphous polyester resin polymerized by the titanium-containing catalyst and crystalline polyester resin polymerized by the tin-containing catalyst are combined, the molecular weight of amorphous polyester resin may not be increased to a desired range, and fixability may not be satisfied under the normal fixing condition or chargeability may be degraded.

Hereinafter, the configuration of an electrostatic image developing toner of the invention will be described in detail.

The toner according to the exemplary embodiment of the invention contains a binder resin, a colorant, and a releasing agent. Here, the binder resin needs to contain amorphous polyester resin and crystalline polyester resin.

(Amorphous Polyester Resin)

The amorphous polyester resin used herein unit polyester resin that, in a differential scanning calorimetry (DSC), does not show an endothermic peak corresponding to a crystal melting temperature, excluding a stepwise endothermic temperature corresponding to glass transition.

As the amorphous polyester resin, known polyester resin may be used. The amorphous polyester resin is formed by synthesizing a polyvalent carboxylic acid component and a polyhydric alcohol component. Further, as the amorphous polyester resin, a commercialized product may be used or a synthetic resin may be used. In addition, the amorphous polyester resins may be used alone, or two or more of the amorphous polyester resins may be used in combination.

The polyvalent carboxylic acid and the polyhydric alcohol used in the amorphous polyester resin are not particularly limited. For example, monomers described in 'Polymer Data Handbook: Basic Part' (edited by the society of Polymer Science, Japan; and published by Baifukan Co., Ltd.), and known divalent or trivalent or more carboxylic acid and divalent or trivalent or more alcohols may be used.

Of the polymerizable monomers, specific examples of the divalent carboxylic acid include dibasic acid, such as succinic acid, alkylsuccinic acid, alkenylsuccinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid, and mesaconic acid, anhydrides or lower alkyl esters thereof, and aliphatic unsaturated dicarboxylic acid, such as maleic acid, fumaric acid, itaconic acid, and citraconic acid. Of these, in view of the balance of the glass transition temperature of polyester resin and flexibility of molecules, the ratio of terephthalic acid is preferably about 30 mol % or more based on the acid component.

Examples of the trivalent or more carboxylic acid include 1,2,4-benzene tricarboxylic acid, 1,2,5-benzene tricarboxylic acid, 1,2,4-naphthalene tricarboxylic acid, and anhydrides or lower alkyl esters thereof. The trivalent or more carboxylic acid may be used alone, or two or more trivalent or more carboxylic acid may be used in combination.

Of the polyhydric alcohols, examples of the dihydric alcohol includes bisphenol derivatives, such as hydrogenated bisphenol A and ethylene oxide or propylene oxide adducts of bisphenol A; cyclic aliphatic alcohols, such as 1,4-cyclohexane diol and 1,4-cyclohexane dimethanol; linear diols, such as ethylene glycol, diethylene glycol, propylene glycol, dipropylene glycol, 1,4-butane diol, 1,5-pentane diol, and 1,6-hexane diol; branched diols, such as 1,2-propane diol, 1,3-butane diol, neopentyl glycol, and 2,2-diethyl-1,3-propane diol. In view of the chargeability or strength, the ethylene oxide or propylene oxide adducts of bisphenol A is preferably used.

Examples of the trivalent or more alcohol include glycerin, trimethylolethane, trimethylolpropane, and pentaerythritol. In view of low-temperature fixability or image glossiness, the ratio of trivalent or more cross-linkable monomer is preferably about 10 mol % or less based on all of the monomers. The cross-linkable monomers may be used alone, or two or more of the cross-linkable monomers may be used in combination.

Moreover, if necessary, for adjustment of the acid value or hydroxyl value, a monovalent acid, such as acetic acid or benzoic acid, or a monohydric alcohol, such as cyclohexanol or benzyl alcohol, may also be used.

Of these, in order to improve the compatibility with the crystalline polyester resin, the ratio of a monomer having a long alkyl side chain, such as 1,2-hexanediol or alkylsuccinic acid and alkenylsuccinic acid, and anhydrides thereof (the side chain has 4 or more carbon atoms), is preferably in a range of about 2 to about 30 mol %. Of these, alkylsuccinic acid, alkenylsuccinic acid, and anhydrides thereof having a high hydrophobic property are preferably contained.

Examples of alkylsuccinic acid, alkenylsuccinic acid, and anhydrides thereof include n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, isododecenylsuccinic acid, and anhydrides and lower alkyl esters thereof.

The number of carbon atoms of an alkyl group or an alkenyl group in the alkylsuccinic acid, alkenylsuccinic acid, and anhydrides thereof is preferably larger than the number of carbon atoms of a monomer used in an aliphatic crystalline polyester resin so as to satisfy the above-described characteristics as the resin. Of these, n-dodecenylsuccinic acid and anhydrides thereof are most preferably used in view of compatibility with aliphatic crystalline polyester resin and easy adjustment of the glass transition temperature of amorphous polyester resin.

The amorphous polyester resin may be prepared from any combination of the above-described monomers by the known methods described, for example, in 'Polycondensation' (Kagaku-dojin Publishing Company), 'Experiments in Polymer Science (polycondensation and polyaddition)' (Kyoritsu Shuppan Co., Ltd.), and 'Polyester Resin Handbook' (Nikkankogyo Shimbun Ed.). An ester exchange method and a direct polycondensation method may be used alone or in combination.

The production of the polyester resin may be usually conducted at a polymerization temperature of about 140 to about 270° C., and if necessary, the pressure within the reaction system is reduced and the reaction is conducted while water and alcohol generated in the condensation reaction are removed. When the monomer does not dissolve or is not compatible under the reaction temperature, a solvent having a high boiling temperature may be added as a solubilizing agent to dissolve the monomer. The polycondensation reaction is conducted while the solubilizing agent is removed. When a poor compatible monomer exists in the copolymerization reaction, the poor compatible monomer may be previously condensed with an acid or an alcohol, which is in the polycondensation program, and then the polycondensation reaction with the main component may be conducted. When the acid component and the alcohol component are reacted, the mol ratio (acid component/alcohol component) varies depending on the reaction condition and cannot be unconditionally decided, but it is usually about 0.9/1 to about 1/0.9 in the direct polycondensation. Further, in the ester exchange method, the monomers, such as ethylene glycol, propylene glycol, neopentyl glycol, and cyclohexanedimethanol, which can be removed under vacuum, may be abundantly used.

A catalyst that can be used in the production of amorphous polyester resin is a tin-containing catalyst, such as tin, tin formate, tin oxalate, tetraphenyltin, dibutyltin dichloride, dibutyltin oxide, and diphenyltin oxide. As the catalyst, the tin-containing catalyst may be primarily used and other catalysts may be mixed.

The tin-containing catalyst includes an organic tin-containing catalyst and an inorganic tin-containing catalyst. The organic tin-containing catalyst is a compound having a Sn—C bond, and the inorganic tin-containing catalyst is a compound not having a Sn—C bond. The tin-containing catalyst includes di-, tri-, and tetra-functional types, but the difunctional type is preferably used herein. In recent years, since safety of the organic tin-containing catalyst is doubtful, the inorganic tin-containing catalyst is preferably used.

Examples of the inorganic tin-containing catalyst includes unbranched tin alkyl carboxylate, such as tin diacetate, tin dihexanoate, tin dioctanoate, and tin distearate, branched and unbranched tin alkyl carboxylate, such as tin dineopentanoate, tin di(2-ethylhexanoate), tin carboxylate, such as tin oxalate, dialkoxytin, such as dioctyloxytin and distearoxytin, halogenated tin, such as tin chloride and tin bromide, tin oxide, and tin sulfate. Particularly, tin dioctanoate, tin distearate, and tin oxide are preferably used.

Other examples of the catalyst include an alkali metal compound, such as sodium or lithium; an alkali earth metal compound, such as magnesium or calcium; a metal compound, such as zinc, manganese, antimony, titanium, zirconium, or germanium; a phosphite compound; a phosphate compound; and an amine compound. Specifically, sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl)phosphite, ethyl triphenyl phosphonium bromide, triethyl amine, and triphenyl amine may be exemplified.

The content of the catalyst to be added when polymerization is preferably in a range of about 0.02 to about 1.0 parts by weight with respect to 100 parts by weight of the monomer. When the catalysts are mixed, the content of the tin-containing catalyst is preferably about 70% by weight or more, and all of the catalysts are more preferably the tin-containing catalyst.

In respects to the molecular weight of the amorphous polyester resin used herein, a weight-average molecular weight Mw is preferably in a range of from about 12000 to about 150000. Particularly, in order to obtain an image having high glossiness, preferably, Mw is in a range of from about 14000 to about 40000, and a number-average molecular weight Mn is in a range of from about 4000 to about 20000. More preferably, Mw is in a range of from about 16000 to about 30000, and Mn is in a range of from about 5000 to about 12000. In addition, Mw/Mn, which is an index of molecular weight distribution, is preferably in a range of from about 2 to about 10. If Mw and Mn are excessively high, chromaticity may be deteriorated. Meanwhile, if Mw and Mn are excessively low, it is difficult to obtain sufficient image strength after fixing, and hot offset may be deteriorated.

In order to improve the hot offset resistance, two kinds of amorphous polyester resin having different molecular weights may be used. At this time, in one amorphous polyester resin, Mw is in a range of from about 35000 to about 70000, and Mn is in a range of from about 5000 to about 20000. In the other amorphous polyester resin, Mw is in a range of from about 10000 to about 25000, and Mn is in a range of from about 3000 to about 12000.

When two or more kinds of amorphous polyester resin are used, at least one amorphous polyester resin preferably contains the alkylsuccinic acid, alkenylsuccinic acid, and anhydrides thereof.

Measurements of the molecular weight and the molecular weight distribution may be conducted by the known methods, but gel permeation chromatography (hereinafter, simply referred to as 'GPC') is generally used.

Measurements of the molecular weight distribution are conducted under the following conditions. The GPC is conducted by using a GPC apparatus (trade name: HLC-8120GPC and SC-8020, manufactured by Tosoh Corporation), columns (trade name: TSK gel and Super HM-H, manufactured by Tosoh Corporation, 6.0 mmID×15 cm×2), and THF (tetrahydrofuran) for chromatography (manufactured by Wako Pure Chemical Industries, Ltd.) as an eluent. An experiment is conducted under the condition including a sample concentration: 0.5% by weight, a flow rate: 0.6 ml/min, a sample injection amount: 10 μl, and a measuring temperature: 40° C. The calibration curve is prepared using 10 samples: A-500, F-1, F-10, F-80, F-380, A-2500, F-4, F-40, F-128, and F-700. In the sample analysis, a data collection period is 300 ms.

The acid value of amorphous polyester resin is preferably in a range of from about 5 to about 25 mgKOH/g, and more preferably in a range of from about 7 to about 20 mgKOH/g.

Measurement of the acid value is conducted as follows. First, 2 g resin is weighed accurately and dissolved in 160 ml acetone-toluene. At this time, when the resin is not sufficiently dissolved, the resin may be heated and dissolved. Then, the acid value is measured using the resultant sample by the potentiometric titration method defined by JIS K0070-1992. The same is applied to the following description.

The hydroxyl value measured by JIS K0070 is preferably in a range of from about 5 to about 40 mgKOH/g.

The glass transition temperature of amorphous polyester resin is preferably in a range of from about 30 to about 90° C., and more preferably, in a range of from about 50 to about 70° C. in view of balance of storage stability and toner fixability. If the glass transition temperature is less than about 30° C., the toner may cause blocking (toner particles cohere and form an aggregate) during storage or within the developing unit. Meanwhile, if the glass transition temperature exceeds about 90° C., the fixing temperature of the toner may be increased.

The glass transition temperature of amorphous polyester resin is obtained using a differential scanning calorimeter (trade name: DSC3110, manufactured by Mac Science Co., Ltd., thermal analysis system 001) by rising the temperature from 0° C. to 150° C. at a rate of 10° C./minute, holding the temperature at 150° C. for 5 minutes, falling the temperature from 150° C. to 0° C. using liquid nitrogen at a rate of −10° C./minute, holding the temperature at 0° C. for 5 minutes, and rising the temperature from 0° C. to 150° C. at a rate of 10° C./minute again. That is, the glass transition temperature of amorphous polyester resin may be defined as an onset temperature that is analyzed from an endothermic curve when second temperature rising.

A softening temperature of amorphous polyester resin is preferably in a range of from about 80 to about 130° C., and more preferably, in a range of from about 90 to about 120° C. If the softening temperature is less than about 80° C., the toner and image stability of the toner may be deteriorated after fixing and during storage. Meanwhile, if the softening temperature exceeds about 130° C., low-temperature fixability may be deteriorated.

The softening temperature of resin indicates an intermediate temperature of a melting initiation temperature and a melting completion temperature, which is measured using a flow tester (trade name: CFT-500C, manufactured by Shimadzu Corporation) under the conditions including a sample amount: 1.05 g, preheating: 300 seconds at 65° C., a plunger pressure: 0.980665 MPa, a die size: diameter 1 mm, a temperature rising rate: 1.0° C./minute.

When a temperature at which the loss elastic modulus G" of amorphous polyester resin (under the conditions including a measuring frequency: 1 rad/s and a distortion: 20% or less) becomes 10000 Pa is Tm, Tm is preferably in a range of from about 80 to about 150° C.

Here, the loss elastic modulus of resin is measured as follows. As a measuring apparatus, a rheometer (trade name: RDA II, manufactured by Rheometrics Co., Ltd., RHIOS system ver. 4.3) is used. A parallel plate having a diameter of 8 mm is used as a measuring plate. Under the conditions including a zero point adjustment temperature: 90° C., an inter-plate gap: 3.5 mm, a temperature rising rate: 1° C./minute, an initial measured distortion: 0.01%, and a measurement initiation temperature: 30° C., the distortion is adjusted while the temperature rises such that a detection torque becomes 10 gcm. The maximum distortion is set to be 20%. When the detection torque is lower than the minimum value of a measurement certified range, measurement is completed.

The content of amorphous polyester resin in the binder resin is not particularly limited, but it is preferably in a range of from about 80 to about 98% by weight, and more preferably, in a range of from about 86 to about 98% by weight. If the content is less than about 80% by weight, strength of the toner may be degraded and charging stability may be deteriorated. If the content is more than about 98% by weight, low-temperature fixability may not be exhibited.

For the binder resin, different kinds of resins than the amorphous polyester resin can be used as the amorphous resin. However, the main component of the amorphous resin is the amorphous polyester resin.

Examples of different kinds of resin include polystyrene, poly(meth)acrylic acid, and an esterified compound thereof. Specific examples include polymers of monomers, for example, styrenes, such as styrene, parachlorostyrene, and α-methyl styrene; esters having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinyl nitriles, such as acrylonitrile, and methacrylonitrile; vinyl ethers, such as vinyl methyl ether and vinyl isobutyl ether; vinyl ketones, such as vinyl methyl ketone, vinyl ethyl ketone, and vinyl isopropenyl ketone; polyolefins, such as ethylene, propylene, and butadiene; and copolymers or mixtures obtained by combining two or more of the above monomers. Further, non-vinyl condensation resin, such as epoxy resin, polyester resin, polyurethane resin, polyamide resin, cellulose resin, and polyether resin, mixtures of the non-vinyl condensation resin and the vinyl-based resins, and graft polymers obtained by polymerizing the vinyl-based monomers in the presence of the above-described polymers. Of these, in view of the chargeability or fixability, styrene-acrylic copolymer resin, and particularly, styrene butyl acrylate copolymer resin is preferably used.

(Crystalline Polyester Resin)

The crystalline polyester resin is used to improve image glossiness, stability, and low-temperature fixability as the binder resin of the toner. The crystalline polyester resin used herein is obtained by synthesizing a divalent acid (dicarboxylic acid) component and a dihydric alcohol (diol) component. In the invention, the 'crystalline polyester resin' indicates a material having a clear endothermic peak in the differential scanning calorimetry (DSC), with no stepwise endothermic change. Further, in a polymer, in which a different component is polymerized with respect to the main chain of the crystalline polyester resin, if a different component is about 50% by weight or less, the copolymer is also called a crystalline polyester resin.

In the crystalline polyester resin, as acid as an acid-derived component, various kinds of dicarboxylic acid may be exemplified. The dicarboxylic acid as the acid-derived component is not limited to one kind of dicarboxylic acid, but two or more dicarboxylic acid-derived components may be contained. In addition, the dicarboxylic acid may contain a sulfonic group to obtain good emulsification ability in an emulsification and aggregation method.

Moreover, the 'acid-derived component' indicates a component that was an acid component before the polyester resin is synthesized. An 'alcohol-derived component' indicates a component that was an alcohol component before the polyester resin is synthesized.

As the dicarboxylic acid, aliphatic dicarboxylic acid, particularly, straight-chain carboxylic acid is preferably used. Examples of the straight-chain carboxylic acid include oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,18-octadecane dicarboxylic acid, 1,20-eicosane dicarboxylic acid, lower alkyl esters and acid anhydrides thereof.

Of these, dicarboxylic acid having about 6 to about 10 carbon atoms is preferably used in view of the crystal melting temperature or chargeability. To increase crystallinity, the ratio of straight-chain dicarboxylic acid is preferably about 95 mol % or more based on the acid component, and more preferably about 98 mol % or more.

As the acid-derived component, in addition to the above-described aliphatic dicarboxylic acid-derived component, a component, such as a dicarboxylic acid-derived component having a sulfonic group may be contained. The dicarboxylic acid having the sulfonic group is advantageous in that it can allow good dispersion of a colorant, such as a pigment. Further, if the sulfonic group is present when the entire resin is emulsified or suspended to produce the toner particles, as described below, emulsification or suspension can be conducted without using a surfactant.

Examples of the dicarboxylic acid having the sulfonic group include 2-sulfoterephthalic acid sodium salt, 5-sulfoisophthalic acid sodium salt, sulfosuccinic acid sodium salt, but these are not intended to limit the invention. Further, lower alkyl esters and acid anhydrides thereof may be exemplified. Of these, in view of productivity, 5-sulfoisophthalic acid sodium salt is preferably used. The content of dicarboxylic acid having the sulfonic group is preferably about 2.0% or less by constitutional mole, and more preferably, about 1.0% or less by constitutional mole. If the content is large, the chargeability may be deteriorated. Moreover, the '% by constitutional mole' represents a percentage when the amount of each component in the polyester resin (acid-derived component and alcohol-derived component) is 1 unit (mol).

In the crystalline polyester resin, as alcohol for the alcohol-derived component, aliphatic dialcohol is preferably used. Examples of alcohol include ethylene glycol, 1,3-propane diol, 1,4-butane diol, 1,5-pentane diol, 1,6-hexane diol, 1,7-heptane diol, 1,8-octane diol, 1,9-nonane diol, 1,10-decane diol, 1,11-dodecane diol, 1,12-undecane diol, 1,13-tridecane diol, 1,14-tetradecane diol, 1,18-octadecane diol, and 1,20-eicosane diol. Of these, a material having 2 to 10 carbon atoms is preferably used in view of the crystal melting temperature or chargeability. In order to increase crystallinity, the straight-chain dialcohol is preferably used in an amount of about 95 mol % or more, and more preferably, about 98 mol % or more, based on the alcohol component.

Other examples of dihydric alcohol include bisphenol A, hydrogenated bisphenol A, ethylene oxide or (and) propylene oxide adducts of bisphenol A, 1,4-cyclohexane diol, 1,4-cyclohexane dimethanol, diethylene glycol, propylene glycol, dipropylene glycol, 1,3-butane diol, and neopentyl glycol. The dihydric alcohols may be used alone, or two or more of dihydric alcohols may be used in combination.

If necessary, for adjustment of the acid value or hydroxyl value, mono valence acid, such as acetic acid or benzoic acid, or monohydric alcohol, such as cyclohexanol or benzyl alcohol, benzene tricarboxylic acid, naphthalene tricarboxylic acid, lower alkyl esters and acid anhydrides thereof and trihydric alcohol, such as glycerin, trimethylolethane, trimethylolpropane, and pentaerythritol may be used.

Other monomers are not particularly limited, but monomers such as known divalent carboxylic acid and dihydric alcohol described in 'Polymer Data Handbook: Basic Part' (edited by The Society of Polymer Science, Japan; and published by Baifukan Co., Ltd.) may be used. Of the monomers, specific examples of the divalent carboxylic acid include dibasic acid, such as phthalic acid, isophthalic acid, terephthalic acid, naphthalene-2,6-dicarboxylic acid, naphthalene-2,7-dicarboxylic acid, cyclohexane dicarboxylic acid, and anhydride or lower alkyl esters thereof. These monomers may be used alone, or two or more of the monomers may be used in combination.

The crystalline polyester resin can be synthesized based on the method described in the section of the amorphous polyester resin. The catalyst that can be used in the production is the titanium-containing catalyst. Examples of the titanium-containing catalyst include aliphatic titanium carboxylates, for example, aliphatic titanium monocarboxylate, such as titanium acetate, titanium propionate, titanium hexanoate, and titanium octanoate, aliphatic titanium dicarboxylate, such as titanium oxalate, titanium succinate, titanium maleate, titanium adipate, and titanium sebacate, aliphatic titanium tricarboxylate, such as titanium hexane tricarboxylate and titanium isooctane tricarboxylate, and aliphatic titanium polycarboxylate, such as titanium octane tetracarboxylate and titanium decane tetracarboxylate, aromatic titanium carboxylates, for example, aromatic titanium monocarboxylate, such as titanium benzoate, aromatic titanium dicarboxylate, such as titanium phthalate, titanium terephthalate, titanium isophthalate, titanium naphthalene dicarboxylate, titanium biphenyl dicarboxylate, titanium anthracene dicarboxylate; aromatic titanium tricarboxylate, such as titanium trimellitate and titanium naphthalene tricarboxylate; aromatic titanium tetracarboxylate, such as titanium benzene tetracarboxylate and titanium naphthalene tetracarboxylate; titanyl compounds and alkali metal salts of aliphatic titanium carboxylates or aromatic titanium carboxylates, halogenated titanium compounds, such as dichlorotitanium, trichlorotitanium, tetrachlorotitanium, and tetrabromotitanium, tetra alkoxy titanium compounds, such as tetrabutoxy titanium (titanium tetrabutoxide), tetraoctoxy titanium, and tetrastearoxy titanium, titanium acetylacetonato, titanium diisopropoxide bisacetylacetonato, and titanium triethanol aminate.

As the catalyst, the titanium-containing catalyst may be primarily used, and other catalysts may be mixed. As other catalysts, materials described in the section of the amorphous polyester resin may be used.

The content of the catalyst to be added when polymerization is preferably in a range of from about 0.02 to about 1.0 parts by weight with respect to 100 parts by weight of the monomer. When the catalysts are mixed, preferably, the content of the titanium-containing catalyst is about 70% by weight or more, and all of the catalysts are more preferably the titanium-containing catalyst.

The melting temperature of crystalline polyester resin is preferably in a range of from about 50 to about 120° C., and more preferably, in a range of from about 60 to about 110° C. If the melting temperature is lower than about 50° C., the storage ability of the toner or the stability of the toner image after fixing may become problematic. Further, if the melting temperature is higher than about 120° C., sufficient low-temperature fixing cannot be obtained, compared with the known toner.

Moreover, the melting temperature of the crystalline polyester resin can be measured as a peak temperature of the endothermic peak based on melting in the same manner as for the glass transition temperature of the amorphous polyester resin.

A differential thermoanalysis that calculates the melting temperature is conducted by the differential scanning calorimetry based on ASTM D3418-8. This measurement is conducted as follows.

First, a toner to be measured is set on a differential scanning calorimeter (trade name: DSC-50, manufactured by Shimadzu Corporation) having an automatic tangential line processing system and liquid nitrogen is set as a cooling medium. Next, the toner is heated from 20° C. to 150° C. at a rate of 10° C./minute (first temperature rising process), and then the relationship between temperature (° C.) and quantity of heat (mW) is determined. Next, the toner is cooled to 0° C. at a rate of −10° C./minute and then is heated again to 150° C. at a rate of 10° C./minute (second temperature rising process), and subsequently data is extracted. Moreover, the toner is retained at 0° C. and 150° C. for 5 minutes. An endothermic peak temperature in the second temperature rising process is regarded as the melting temperature. Moreover, the crystalline resin shows a plurality of melting peaks, and the maximum peak among them is regarded as the melting temperature.

In regards to the molecular weight of the crystalline polyester resin, in measurement of the molecular weight of the soluble component in tetrahydrofuran (THF) by the GPC method, the weight-average molecular weight Mw is preferably in a range of from about 5000 to about 100000, and more preferably, in a range of from about 10000 to about 50000. The number-average molecular weight Mn is preferably in a range of from about 2000 to about 30000, and more preferably, in a range of from about 5000 to about 15000. The molecular weight distribution Mw/Mn is preferably in a range of from about 1.5 to about 20, and more preferably, in a range of from about 2 to about 5. If the weight-average molecular weight and the number-average molecular weight are smaller than the above-described ranges, respectively, low-temperature fixability is effective but flexible as the resin, and thus an adverse affect may arise, such as blocking of the toner, on the storage ability. Meanwhile, if the molecular weight is larger than the above-described range, exudation from the toner is insufficient, and thus an adverse effect on document storage ability may arise. Accordingly, when the molecular weight is measured, since the crystalline resin has poor solubility with respect to THF, the crystalline resin is preferably heated and dissolved in a hot-water bath at about 70° C.

The acid value of the crystalline polyester resin is preferably in a range of from about 4 to about 20 mgKOH/g, and more preferably, in a range of from about 8 to about 15 mgKOH/g. Further, the hydroxyl value is preferably in a range of from about 3 to about 30 mgKOH/g, and more preferably, in a range of from about 5 to about 10 mgKOH/g.

In the exemplary embodiment of the invention, the acid value of the amorphous polyester resin and the acid value of the crystalline polyester resin are in a range of from more than about 7 mgKOH/g to less than about 20 mgKOH/g, respectively, and the acid value of the amorphous polyester resin is preferably set to be larger than the acid value of the crystalline polyester resin. Accordingly, when the toner is manufactured in a wet process described below, the amorphous polyester resin easily comes out from the surface of the toner, and intension ability of the crystalline polyester resin is improved. Therefore, toner durability for recycling is improved.

Each of the acid values of the amorphous polyester resin and the crystalline polyester resin from the components of the toner is determined by the following method.

First, the crystalline resin and the amorphous resin in the toner are separated. The toner is left in a constant temperature bath at temperature 50° C. and humidity 55 RH % for 24 hours, and a heat history of the toner is cancelled. Next, 10 g of the toner is dissolved in 100 g of methyl ethyl ketone (MEK) at normal temperature (about 20 to about 25° C.). This is because, when the crystalline resin and the amorphous resin are contained in the toner, only the amorphous resin is dissolved in MEK at the normal temperature. Accordingly, since the amorphous resin including the amorphous polyester resin is contained in the MEK-soluble component, amorphous polyester resin is obtained from a supernatant liquid centrifuged by centrifugation (a centrifugal separator (trade name: 'H-18', manufactured by Kokusan Co., Ltd.), at 3500 rpm for 20 minutes) after being dissolved. The solid component after centrifugation is dissolved in 100 g of MEK and centrifuged again, and a supernatant is discarded. Meanwhile, the solid component after centrifugation is dissolved in 100 g of MEK while being heated at 70° C. and then centrifuged. Then, the crystalline polyester resin is obtained from the centrifuged supernatant liquid.

For both resins obtained in the above-describe manner, the acid values are measured by the above-described method.

The content of the crystalline polyester resin in the binder resin is preferably in a range of from about 2 to about 20% by weight, and more preferably, in a range of from about 2 to about 14% by weight. If the addition amount of the crystalline polyester resin is larger than about 20% by weight, the domain of the crystalline polyester resin becomes large, and is likely to be exposed from the surface of the toner. Accordingly, toner particle flowability may be degraded or chargeability may be deteriorated. If the addition amount is smaller than about 2% by weight, good low-temperature fixability may not be obtained.

In the binder resin, different kinds of resins than the crystalline polyester resin may be used as the crystalline resin. However, the main component of the amorphous resin is the amorphous polyester resin.

The content of different kinds of resins in the binder resin is less than about 3% by weight. Examples of other resins include vinyl-based resins containing one or two or more (meth)acrylate esters of long-chain alkyl or alkenyl, for example amyl(meth)acrylate, hexyl(meth)acrylate, heptyl (meth)acrylate, octyl(meth)acrylate, nonyl(meth)acrylate, decyl(meth)acrylate, undecyl(meth)acrylate, tridecyl(meth) acrylate, myristyl(meth)acrylate, cetyl(meth)acrylate, stearyl (meth)acrylate, oleyl(meth)acrylate, behenyl(meth)acrylate, and olefins, such as ethylene, propylene, butadiene, and isoprene.

(Colorant)

As the colorant used in the toner of the exemplary embodiment of the invention, a yellow pigment is exemplified. Examples of the yellow pigment include chrome yellow, zinc yellow, yellow iron oxide, cadmium yellow, chromium yellow, Hansa yellow, Hansa yellow 10G, benzidine yellow G, benzidine yellow GR, threne yellow, quinoline yellow, and permanent yellow NCG. Particularly, C.I. pigment yellow 17, C.I. pigment yellow 74, C.I. pigment yellow 97, C.I. pigment yellow 155, C.I. pigment yellow 180, and C.I. pigment yellow 185 may be preferably used.

Examples of a magenta pigment include red iron oxide, cadmium red, red lead, mercury sulfide, watchung red, permanent red 4R, lithol red, brilliant carmine 3B, brilliant carmine 6B, DuPont Oil red, pyrazolone red, rhodamine B lake, lake red C, rose bengal, eoxine red, alizarin lake, naphthol pigments, such as pigment red 31, pigment red 146, pigment red 147, pigment red 150, pigment red 176, pigment red 238, and pigment red 269, and quinacridone pigments, such as pigment red 122, pigment red 202, and pigment red 209. Of these, in view of productivity and chargeability, pigment red 185, pigment red 238, pigment red 269, and pigment red 122 are preferably used.

Examples of a cyan pigment include iron blue, cobalt blue, alkali blue lake, Victoria blue lake, fast sky blue, Indanthrene blue BC, aniline blue, ultramarine blue, Calco Oil blue, methylene blue chloride, phthalocyanine blue, phthalocyanine green, malachite green oxalate. Particularly, C.I. pigment blue 15:1, and C.I. pigment blue 15:3 are preferably used.

Examples of an orange pigment include chrome yellow, molybdenum orange, permanent orange GTR, pyrazolone orange, Vulcan orange, benzidine orange G, indathrene brilliant orange RK, and indathrene brilliant orange GK. Examples of a violet pigment include manganese violet, fast violet B, and methyl violet lake. Examples of a green pigment include chromium oxide, chromium green, pigment green, malachite green lake, and final yellow green G.

Examples of a white pigment include zinc white, titanium oxide, antimony white, and zinc sulfide.

Examples of an extender pigment include barite powder, barium carbonate, clay, silica, white carbon, talc, and white alumina. Further, various dyes, such as acridines, xanthenes, azos, benzoquinones, azines, anthraquinones, Thioindigos, dioxazines, thiazines, azomethines, Indigos, phthalocyanines, aniline blacks, polymethines, triphenylmethanes, diphenylmethanes, thiazines, thiazoles, and xanthenes, may be used. In addition, the colorants may be used alone or in combination.

Examples of a black pigment that is used in a black toner include carbon black, copper oxide, manganese dioxide, aniline black, and active carbon. Particularly, carbon black is preferably used. Since carbon black has relatively good dispersibility, carbon black does not need special dispersion, but it is preferably manufactured in the same manufacturing method for a color colorant.

The colorant is selected in view of hue angle, chroma, brightness, weather resistance, OHP transparency, and dispersibility in the toner. Accordingly, the colorant is preferably added in an amount of from about 4 to about 15% by weight with respect to the total weight of the toner. Further, when a magnetic material is used as the black colorant, it can be added in an amount of from about 12 to about 240% by weight, which is different from other colorants. Specifically, as the magnetic material, a material that can be magnetized in a magnetic field is used, and examples thereof include ferromagnetic powder, such as iron, cobalt, and nickel, and compounds, such as ferrite and magnetite. When the toner is obtained in an aqueous medium, it is necessary to pay attention to aqueous phase migration of the magnetic material, and the surface of the magnetic material is preferably modified in advance, for example, subjected to a hydrophobic treatment.

(Releasing Agent)

The toner of the exemplary embodiment of the invention contains a releasing agent to improve fixability or image storage stability. As the releasing agent to be used, a material having a main maximum endothermic peak of from about 60 to about 120° C. in the DSC measured based on ASTM D3418-8, and melting viscosity of from about 1 to about 50 mPa·s at 140° C. is preferably used. When the melting temperature is less than about 60° C., the change temperature of the releasing agent is excessively low, and thus blocking resistance may be degraded, or developability may be deteriorated when the temperature in the copy machine is increased. If the melting temperature exceeds about 120° C., the change temperature of the releasing agent (for example, wax) is excessively high. In this case, fixing is advantageously conducted at a high temperature, but it may be undesirable in view of energy saving. In addition, at the melting viscosity higher than about 50 mPa·s at 140° C., exudation from the toner may be weak, and releasability at fixation may be insufficient.

The endothermic initiation temperature of the releasing agent is preferably about 40° C. or more, and more preferably, about 50° C. or more, in the DSC curve, which is measured by the differential scanning calorimeter. If the endothermic initiation temperature is lower than about 40° C., the toner may be aggregated within the copy machine or the toner bottle. The endothermic initiation temperature varies depending to the kind and quantity of the low molecular weight fraction within the molecular weight distribution of the releasing agent (for example, wax), as well as the kind and quantity of polar groups within the low molecular weight fraction.

Generally, if the molecular weight is increased, the endothermic initiation temperature increases together with the melting temperature, however the increase in the endothermic initiation temperature results in a loss of the inherent low melting temperature and low viscosity of the releasing agent (for example, wax). Accordingly, it is advantageous to selectively remove the low molecular weight fraction from the molecular weight distribution of the releasing agent (for example, wax). Suitable methods therefor include molecular distillation, solvent fractionation, and gas chromatographic separation.

If the maximum endothermic peak in the DSC curve is less than about 50° C., an offset may be likely to occur when fixing. Meanwhile, if the peak exceeds about 140° C., since the fixing temperature increases, smoothness of the surface of the fixed image may not be obtained and glossiness may be damaged.

The measurement of the DSC is as described above.

The melting viscosity of the releasing agent is measured by an E-type viscometer. During measurement, an E-type viscometer (manufactured by Tokyo Keiki Co., Ltd.) equipped with an oil circulating constant temperature bath is used. Measurements are conducted using a cone plate-cup combination plate with a cone angle of 1.34 degrees. The sample is placed in the cup, with the temperature of the circulation device set to 140° C., an empty measuring cup and cone are set in the measuring device, and a constant temperature is maintained while the oil is circulated. Once the temperature has stabilized, the 1 g sample is placed in the measuring cup and then allowed to stand for 10 minutes with the cone in a stationary state. After stabilization, the cone is rotated and the measurement is conducted. The cone rotational speed is set to 60 rpm. The measurement is conducted three times, and the average of the resultant values is recorded as the melting viscosity $\eta$.

Specific examples of the releasing agent include low-molecular-weight polyolefins, such as polyethylene, polypropylene, and polybutene, silicones that show a softening temperature under heating, fatty acid amides such as oleyl amide, erucyl amide, ricinoleyl amide, and stearyl amide, vegetable waxes, such as carnauba wax, rice wax, candelilla wax, Japan wax, and jojoba oil, animal waxes, such as bees wax, ester waxes, such as fatty acid esters and montanate esters, mineral or petroleum waxes, such as montan wax, ozokerite, ceresin, paraffin wax, microcrystalline wax, and Fischer-Tropsch wax, and modified products thereof.

(Other Additives)

Inorganic particles or organic particles may also be added to the toner according to the exemplary embodiment of the invention, if necessary. The reinforcing effect of these particles may improve the storage elastic modulus of the toner, and may also improve an offset resistance or releasability from the fixing device. In addition, these particles may also improve dispersibility of the internal additives, such as the colorant and the releasing agent.

Examples of the inorganic particles include silica, hydrophobized silica, alumina, titanium oxide, calcium carbonate, magnesium carbonate, tricalcium phosphate, colloidal silica, alumina-treated colloidal silica, cation surface-treated colloidal silica, and anion surface-treated colloidal silica, all of which may be alone or in combination thereof. Of these, in view of OHP transparency and dispersibility within the toner, colloidal silica is particularly desirable. The particle diameter thereof is preferably in a range of from about 5 to about 50 nm. Further, combinations of particles of different sizes may also be used. Although the particles can be added directly during the production of the toner, in order to improve dispersibility, the use of a dispersion that has been produced in advance using an ultrasound disperser or the like to disperse the particles in an aqueous medium, such as water is desirable. In this dispersion, an ionic surfactant and a polymeric acid or polymeric base may also be used to further improve dispersibility.

Other known materials, such as a charge control agent, may also be added to the toner according to the exemplary embodiment of the invention. The average particle diameter of the added materials is preferably 1 μm or less, and more preferably, in a range of from about 0.01 to about 1 μm. If the average particle diameter exceeds 1 μm, the particle diameter distribution of the final product electrostatic latent image developing toner becomes wide, free particles are generated, and performance and reliability of the toner may be deteriorated. Meanwhile, if the average particle diameter falls within the above range, the above-described drawbacks can be avoided, and other advantages are also realized, including a reduction in uneven distribution within the toner, more favorable dispersion within the toner, and less variation in performance and reliability of the toner. The average particle diameter may be measured, for example, using a Microtrack or the like.

A method of manufacturing an electrostatic image developing toner according to an exemplary embodiment of the invention will be described in detail.

The method of manufacturing the toner of the exemplary embodiment of the invention is not particularly limited, but a wet production method is preferably used. As the wet production method, known melting suspension, emulsion aggregation, and dissolution suspension methods and the like are exemplified. Hereinafter, a description will be given by way of the emulsion aggregation method.

The emulsion aggregation method includes the steps of preparing an aggregate particle dispersion by forming aggregate particles within a dispersion containing at least dispersed resin particles (hereinafter, sometimes referred to as, 'emulsion liquid') (aggregation step), and heating the aggregate particle dispersion to fuse the aggregate particles (fusion step). Further, a step of forming adhered particles by adding a particle dispersion containing dispersed particles to the aggregate particle dispersion and adhering the particles to the aggregate particles (adhesion step) may also be provided between the aggregation step and the fusion step. The adhesion step is a step of forming adhered particles by adding and mixing particle dispersion with the aggregate particle dispersion prepared in the aggregation step, thereby causing the particles to adhere to the aggregate particles. The added particles may also be referred to as 'addition particles' because the added particles correspond with particles that have been added to the aggregate particles.

In addition the resin particles described above, examples of the addition particles include releasing agent particles and colorant particle and the like, which may be used alone or in combination. The method of adding and mixing the particle dispersion is not particularly limited, and the dispersion may be either added gradually in a continuous manner, or added in a stepwise manner using multiple repetitions. By adding and mixing the particles (addition particles) in this manner, the generation of very fine particles is suppressed, enabling a sharp particle diameter distribution to be achieved for the resultant toner particles, which contributes to a higher quality image. Furthermore, by providing the above-described adhesion step, a pseudo shell structure can be formed, enabling the exposure of internal additives, such as the colorant and the releasing agent at the surface of the toner to be reduced. Therefore, chargeability and lifespan can be improved. In addition, during fusion in the fusion step, the particle diameter distribution can be maintained, and fluctuations in the distribution can be suppressed. As a result, it is possible to remove the necessity for the addition of surfactants or stabilizers, such as bases or acids, to enhance the stability during fusion, or to minimize the additive quantities of such materials, as well as to reduce costs and enable improvement in product quality.

In the toner of the exemplary embodiment of the invention, it is desirable to form the core shell structure by adding the addition particles. The binder resin that is the main component of the addition particles is resin for a shell layer. If this type of method is used, during the fusion step, the shape of the toner particles can be controlled by appropriate adjustment of conditions, such as the temperature, stirring speed, and pH.

When the amorphous polyester resin or the crystalline polyester resin are used in the above-described emulsion aggregation method, for example, an emulsion step of emulsifying the amorphous polyester resin and forming emulsion particles (liquid droplets) is appropriately used.

In the emulsion step, the emulsified particle (liquid droplets) of the amorphous polyester resin are formed by imparting a shearing force to a solution, in which an aqueous medium, polyester resin, and if necessary, a mixed liquid containing the colorant (polymer liquid) are mixed. At this time, by heating above the glass transition temperature of the amorphous polyester resin, viscosity of the polymer liquid is decreased, thereby forming the emulsion particles. Further, a dispersant may also be used to stabilize the emulsified particle and increase the viscosity of the aqueous medium. Hereinafter, a dispersion containing the emulsion particles may also be referred to as 'resin particle dispersion'.

Examples of an emulsification device that is used to form the emulsion particles include a homogenizer, a homomixer, a pressure kneader, an extruder, and a media dispersion device. The size of the emulsion particles (liquid droplets) of the polyester resin, reported as an average particle diameter (volume-average particle diameter), is preferably in a range of from about 0.005 to about 0.5 μm, and more preferably, from about 0.01 to about 0.3 μm. If the particle diameter is about 0.005 μm or less, the particles are dissolved in water, and it is difficult to produce the particles. Meanwhile, if the particle diameter is about 0.5 μm or more, it is difficult to obtain particles having a desired particle range of from about 3.0 to about 7.5 μm. Moreover, the volume-average particle diameter of the resin particles is measured by a Doppler scattering particle diameter distribution analyzer (trade name: Microtrack UPA9340, manufactured by Nikkiso Co., Ltd.).

If the melting viscosity of the resin during emulsification is high, the particle diameter cannot be made small to a desired value. Accordingly, by performing emulsification in a state where the viscosity of the resin is decreased by increasing the temperature with the emulsification device capable of pressing at an atmosphere pressure or more, the resin particle dispersion containing resin particles having a desired particle diameter range can be obtained.

In the emulsion step, a method that adds a solvent to the resin in advance to decrease the viscosity of the resin, thereby improving the emulsification ability, may be used. The solvent to be used is not particularly limited insofar as it can dissolve the polyester resin, but examples of the solvent include ketone-based solvents, such as tetrahydrofuran (THF), methyl acetate, ethyl acetate, and methyl ethyl ketone, and benzene-based solvents, such as benzene, toluene, and xylene. In view of solubility and solvent removability, ester- and ketone-based solvents, such as ethyl acetate and methyl ethyl ketone, are preferably used.

In order to improve affinity to water as a medium and control the particle diameter distribution, an alcoholic solvent, such as ethanol or isopropyl alcohol, may be directly added to water or the resin.

In order to control the particle diameter distribution, salts, such as sodium chloride and potassium chloride, or ammonia may also be added. Of these, ammonia is preferably used.

In order to control the particle diameter distribution, a dispersant may also be added. Examples of the dispersant include water-soluble polymers, such as polyvinyl alcohol, methylcellulose, carboxymethyl cellulose, and sodium polyacrylate; and surfactants, including anionic surfactants, such as sodium dodecylbenzenesulfonate, sodium octadecylsulfate, sodium oleate, sodium laurate, and potassium stearate; cationic surfactants, such as laurylamine acetate and lauryltrimethylammonium chloride; and amphoteric ionic surfactants, such as lauryldimethylamine oxide; nonionic surfactants, such as polyoxyethylene alkylether, polyoxyethylene alkylphenylether, and polyoxyethylene alkylamine; and inorganic compounds, such as tricalcium phosphate, aluminum hydroxide, calcium sulfate, calcium carbonate, and barium carbonate. Of these, the anionic surfactants are preferably used. The content of the dispersant is preferably in a range of from about 0.01 to about 20 parts by weight with respect to 100 parts by weight of the polyester resin (binder resin).

During the emulsion step, if dicarboxylic acid having a sulfonic group is copolymerized in the polyester resin (that is, a dicarboxylic acid-derived component having a sulfonic group is contained in an acid-derived component in an appropriate amount), the amount of a dispersion stabilizer, such as a surfactant, can be reduced, or the emulsion particles can be formed without using the dispersion stabilizer. However, hygroscopicity property of the resin may be increased and chargeability may be deteriorated. The addition amount of the dicarboxylic acid-derived component having a sulfonic group is preferably about 10 mol % or less based on the acid component, but when emulsification ability can be ensured due to hydrophilicity of the main chain of the polyester resin, and the acid value and hydroxyl value at the terminal, the dicarboxylic acid-derived component having a sulfonic group does not need to be added.

A phase inversion emulsion method may also be used in forming the emulsion particles. The phase inversion emulsion method includes the steps of dissolving at least polyester resin in an organic solvent, adding a neutralizer or a dispersion stabilizer, if necessary, dropping an aqueous solvent while stirring, obtaining emulsion particles, and removing the solvent in the resin dispersion, thereby obtaining an emulsion liquid. At this time, the sequence in which the neutralizer or the dispersion stabilizer is added may be changed.

Examples of the organic solvent that dissolves the resin include formate esters, acetate esters, butyrate esters, ketones, ethers, benzenes, and halogenated carbons. Specific examples of the organic solvent include methyl, ethyl, n-propyl, isopropyl, n-butyl, isobutyl, sec-butyl, and t-butyl esters of formates, acetates, and butyrates, methylketones, such as acetone, MEK, MPK, MIPK, MBK, and MIBK, ethers, such as diethyl ether and diisopropyl ether, heterocyclic ring substitutions, such as toluene, xylene, and benzene, and halogenated carbons, such as carbon tetrachloride, methylene chloride, 1,2-dichloroethane, 1,1,2-trichloroethane, trichloroethylene, chloroform, monochlorobenzene, and dichloroethylidene. The organic solvents may be used alone, or two or more of the organic solvents may be used in combination. In view of broad accessibility, ease of recycling when removal of the solvent, and environmental consciousness, acetate esters, methylketones, and ethers as a low boiling solvent are preferably used. Particularly, acetone, methyl ethyl ketone, acetic acid, ethyl acetate, and butyl acetate are preferable. If the organic solvent remains in the resin particles, the organic solvent causes the VOC. Accordingly, it is desirable to use an organic solvent having a relatively high volatility. The content of the organic solvent is preferably in a range of from about 20 to about 200% by weight, and more preferably, in a range of from about 30 to about 100% by weight, with respect to the amount of the resin.

As the aqueous solvent, ion-exchanged water is basically used, but it may contain a water-soluble organic solvent unless oil droplets are destroyed. Examples of the water-soluble organic solvent include short carbon chain alcohols, such as methanol, ethanol, 1-propanol, 2-propanol, 1-butanol, 2-butanol, t-butanol, and 1-pentanol; ethyleneglycol monoalkyl ethers, such as ethyleneglycol monomethyl ether, ethyleneglycol monoethyl ether, and ethyleneglycol monobutyl ether; ethers, diols, THF, and acetone. Ethanol and 2-propanol are preferably used. The content of the water-soluble organic solvent is preferably in a range of from about 1 to about 60% by weight, and more preferably, in a range of from about 5 to about 40% by weight, with respect to the amount of the resin. Furthermore, the water-soluble organic solvent may be added to the resin-dissolved liquid, not being mixed with the ion-exchanged water. When the water-soluble organic solvent is added, it is possible to adjust wettability of the resin and the resin-dissolving solvent, and to reduce liquid viscosity after the resin is dissolved.

In order to allow the emulsion liquid to stably maintain the dispersion state, if necessary, a dispersant may also be added to the resin solution and the aqueous component. As the dispersant, a material that is forming a hydrophilic colloid within the aqueous component is used. Examples of the dispersant include cellulose derivatives, such as hydroxymethyl cellulose, hydroxyethyl cellulose, and hydroxypropyl cellulose; synthetic polymers, such as polyvinyl alcohol, polyvinyl pyrolidone, polyacryl amide, polyacrylate salt, and polymethacrylate salt, and dispersion stabilizers, such as gelatin, gum arabic, and Japanese gelatin. Furthermore, solid fine power, such as silica, titanium oxide, alumina, tricalcium phosphate, calcium carbonate, calcium sulfate, and barium carbonate. The dispersion stabilizers are added to the aqueous component with a concentration of from about 0 to about 20% by weight, and preferably, from about 0 to about 10% by weight. As the dispersant, a surfactant may also be used. Examples of the surfactant are based on a material for a colorant dispersion described below. For example, in addition to a natural surfactant component, such as saponin, cationic surfactants, such as alkylamine hydrochloride/acetate salt, quaternary ammonium salt, and glycerins, and anionic surfactants, such as fatty acid soaps, sulfate esters, alkylnaphthalene sulfonate salts, sulfonate salts, phosphoric acid, phosphate ester, sulfosuccinate salts, may be used. Of these, anionic surfactants and nonionic surfactants are preferably used. In order to adjust pH of the emulsion liquid, a neutralizer may also be added. Examples of the neutralizer include general acids and alkalis, such as nitric acid, hydrochloric acid, sodium hydroxide, and ammonia.

As the method of removing the organic solvent from the emulsion liquid, a method that volatilizes the organic solvent by heating the emulsion liquid in a range of from about 15 to about 70° C., or a method that further applies reduced pressure to the above-described method is preferably used.

As the method of dispersing the colorant or the releasing agent, general dispersion methods, such as a high-pressure homogenizer, a rotary shearing type homogenizer, an ultrasonic disperser, a high-pressure counter collision disperser, and media mills, such as a ball mill, a sand mill, and a Dino mill, having a media, may be used, but the exemplary embodiment of the invention is not limited thereto.

If necessary, a water dispersion of a colorant may be prepared using the surfactant, or an organic solvent dispersion of a colorant may be prepared using a dispersant. Hereinafter, the dispersion of the colorant or the releasing agent is referred to as 'colorant dispersion' or 'releasing agent dispersion'.

The dispersant that is used in the colorant dispersion or the releasing agent dispersion is generally a surfactant. Examples of the surfactant include anionic surfactants, such as sulfate ester salts, sulfonate salts, phosphate esters, and soaps; cationic surfactants, such as amine salts and quaternary ammonium salts; nonionic surfactants, such as polyethylene glycols, alkyl phenol ethylene oxide adducts, and polyhydric alcohols. Of these, the ionic surfactants are preferably used, and the anionic surfactants and the cationic surfactants are more preferably used. The nonionic surfactants are preferably used together with the anionic surfactants or the cationic surfactants. The surfactants may be used alone, or two or more of the surfactants may be used in combination. Furthermore, the surfactants preferably have the same polarity as the dispersants that are used in other dispersions, such as the releasing agent dispersion.

Specific examples of the anionic surfactant include fatty acid soaps, such as potassium laurate, sodium oleate, and castor oil sodium; sulfate esters, such as octyl sulfate, lauryl sulfate, lauryl ether sulfate, and nonyl phenyl ether sulfate; sulfonate salts, such as lauryl sulfonate, dodecyl sulfonate, dodecylbenzene sulfonate, sodium alkylnaphthalene sulfonate, such as triisopropylnaphthalene sulfonate and dibutylnaphthalene sulfonate, naphthalenesulfonate formalin condensate, monooctylsulfosuccinate, dioctylsulfosuccinate, lauric acid amide sulfonate, and oleic acid amide sulfonate; phosphate esters, such as lauryl phosphate, isopropyl phosphate, nonyl phenyl ether phosphate; sodium dialkylsulfosuccinate, such as sodium dioctylsulfosuccinate; and sulfosuccinate salts, such as disodium lauryl sulfosuccinate, disodium lauryl polyoxyethylenesulfosuccinate. Of these, alkylbenzene sulfonate compounds, such as dodecylbenzene sulfonate and branches thereof, are preferably used.

Specific examples of the cationic surfactant include amine salts, such as laurylamine hydrochloride salt, stearylamine hydrochloride salt, oleylamine acetate salt, stearylamine acetate salt, and stearylaminopropylamine acetate salt; and quaternary ammonium salts, such as lauryl trimethyl ammonium chloride, dilauryl dimethyl ammonium chloride, distearyl ammonium chloride, distearyl dimethyl ammonium chloride, lauryl dihydroxyethyl methyl ammonium chloride, oleyl bis(polyoxyethylene) methyl ammonium chloride, lauroyl aminopropyl dimethyl ethyl ammonium ethosulfate, lauroyl aminopropyl dimethylhydroxyethyl ammonium perchlorate, alkylbenzene dimethyl ammonium chloride, and alkyl trimethyl ammonium chloride.

Specific examples of the nonionic surfactant include alkyl ethers, such as polyoxyethylene octyl ether, polyoxyethylene lauryl ether, polyoxyethylene stearyl ether, and polyoxyethylene oleyl ether; alkyl phenyl ethers, such as polyoxyethylene octyl phenyl ether and polyoxyethylene nonyl phenyl ether; alkyl esters, such as polyoxyethylene laurate, polyoxyethylene stearate, and polyoxyethylene oleate; alkyl amines, such as polyoxyethylene lauryl aminoether, polyoxyethylene stearyl aminoether, polyoxyethylene oleyl aminoether, polyoxyethylene soy aminoether, and polyoxyethylene tallow aminoether; alkyl amides, such as polyoxyethylene lauramide, polyoxyethylene stearamide, and polyoxyethylene oleamide; vegetable oil ethers, such as polyoxyethylene castor oil ether, polyoxyethylene rape seed oil ether; alkanol amides, such as diethanolamide laurate, diethanolamide stearate, and diethanolamide oleate; and sorbitan ester ethers, such as polyoxyethylene sorbitan monolaurate, polyoxyethylene sorbitan monopalmitate, polyoxyethylene sorbitan monostearate, and polyoxyethylene sorbitan monooleate.

The addition amount of the dispersant to be used is preferably in a range of from about 2 to about 30% by weight, and more preferably, in a range of from about 5 to about 20% by weight, with respect to the colorant and the releasing agent. If the amount of the dispersant is excessively small, the particle diameter may not be made small, or storage stability of the dispersion may be degraded. Meanwhile, if the amount of the dispersant is excessively large, the amount of the dispersant that remains in the toner becomes large, and toner chargeability or powder flowability may be degraded.

As the aqueous dispersion medium to be used, distilled water or ion-exchanged water, which has a small amount of impurities, such as metal ions, is preferably used. In addition, for defoaming or adjustment of surface tension, alcohol may also be added. Furthermore, for adjustment of the viscosity, polyvinyl alcohol or cellulose-based polymer may also be added. However, if the polymer remains in the toner, chargeability may be degraded, and thus it is advantageous not to use the polymer as much as possible.

A device that produces the dispersions of various additives is not particularly limited. For example, known dispersion devices, such as a rotary shearing type homogenizer, media mills, such as a ball mill, a sand mill, or a Dino mill, and other devices for the production of the colorant dispersion or the releasing agent dispersion, may be exemplified and selectively used.

During the aggregation step, a flocculant is preferably used to form the aggregate particles. As the flocculant to be used, surfactants having a polarity opposite to the surfactant used for the dispersant, or general inorganic metal compounds (inorganic metal salts) or polymers thereof may be exemplified. The metal element constituting the inorganic metal salt is preferably a metal element having a divalent or higher electric charge and belonging to Groups 2A, 3A, 4A, 5A, 6A, 7A, 8, 1B, 2B, and 3B of the periodic table (long form of the periodic table) and may be sufficient if it dissolves in the form of an ion in the aggregation system of the resin particles.

Specific examples of the inorganic metal salt include metal salts, such as calcium chloride, calcium nitrate, barium chloride, magnesium chloride, zinc chloride, aluminum chloride, aluminum sulfate and inorganic metal salt polymers, such as, polyaluminum chloride, polyaluminum hydroxide, and polycalcium sulfide. Of these, aluminum salts and polymers thereof are preferably used. Generally, in order to obtain sharper particle diameter distribution, the valence of the inorganic metal salt is preferably divalence rather than monovalence and preferably trivalence or higher rather than divalence. Among the inorganic salts having the same valence, a polymerized type inorganic metal salt polymer is more preferably used.

The addition amount of the flocculant varies depending on the kind and valance of the flocculant, but it is basically in a range of from about 0.05 to about 0.1% by weight. The flocculant flows into the aqueous medium or forms coarse powder in the toner preparation process, and little flocculant remains in the toner. Particularly, in the toner preparation process, when the amount of the solvent in the resin is large, the solvent and the flocculant react with each other, and thus the flocculant easily flows into the aqueous medium. Accordingly, it is necessary to adjust the amount of the flocculant according to the residual amount of the solvent.

Due to the addition of the flocculant, the toner of the exemplary embodiment of the invention preferably contains at least one metal element selected from a group consisting of aluminum, zinc, and calcium in an amount of from about 0.003 to about 0.05% at an elemental ratio. If the amount of the metal atom falls within the above-described range, the metal element is ionically cross-linked with the polar component of the polyester resin, which improves strength of the fixed image, thereby improving the hot offset. Meanwhile, if the content is excessively large, melting viscosity may also be increased, glossiness of the fixed image may be degraded or low-temperature fixability may be damaged. Here, the content of the metal element is determined from elemental analysis by a fluorescent X-ray analyzer. The sample to be analyzed is pretreated. Specifically, 6 g of a toner is shaped in a mode of compression molding under a pressure of 10 tons for 1 minute by the use of a compression molding machine. Then, the content is calculated from an elemental ratio using a fluorescent X-ray analyzer (trade name: XRF-1500, manufactured by Shimadzu Corporation) under a measurement condition including a tube voltage: 40 kV, a tube current: 90 mA, and a measurement time: 30 minutes.

During the fusion step, while stirring is conducted at the same rate as that in the aggregation step, pH of a suspension liquid of the aggregate is set in a range of from about 5 to about 10 to interrupt the aggregation. Then, heating is conducted at a temperature above the glass transition temperature Tg of the resin (or a temperature above the melting temperature of crystalline resin) to fuse and coalesce aggregate particles. Further, it may be sufficient that heating is conducted for a time enough to allow desired coalescence, for example, for about 0.2 to about 10 hours. Subsequently, when the temperature falls below Tg of the resin, and the particles are solidified, the shape and surface nature of the particle varies depending on the temperature falling rate. For example, when the temperature falls fast, the amount of sphericity may be increased and surface unevenness are likely to be small. Meanwhile, when the temperature falls slow, the shape of the particles is in an amorphous form, and unevenness is likely to occur at the surface of the particle. For this reason, the temperature preferably falls at a rate of at least about 0.5° C./minute or more, and more preferably, at a rate of about 1.0° C./minute or more below Tg of the resin.

While heating is conducted at a temperature above Tg of the resin, the particles are grown by adjusting pH or adding a flocculant in the same manner as for the aggregation step, to thereby have a desired particle diameter. In the same manner as for the fusion step, if the temperature falls below Tg of the resin at a rate of at least about 0.5° C./minute, and growing of the particles are interrupted simultaneously with solidification of the particles, the aggregation step and the fusion step can be conducted simultaneously. This method is preferable in view of simplification of the process, but it may be difficult to make the above-described core shell structure.

After the fusion step is completed, the particles are washed and dried, thereby obtaining the toner particles. In consideration of toner chargeability, the toner is preferably rinsed with ion-exchanged water, and a degree of cleaning is generally monitored by conductivity of a filtrate. Furthermore, the conductivity of the filtrate is preferably about 25 μS/cm or less. During cleaning, a step of neutralizing ions with acid or alkali may also be provided. In the acid treatment, pH is preferably about 4.0 or less. Meanwhile, in the alkali treatment, pH is preferably about 8.0 or more. In addition, solid-liquid separation after cleaning is not particularly limited, but in view of productivity, methods, such as suction filtration and pressure filtration such as filter press are preferably used. Furthermore, drying is not particularly limited, but in view of productivity, lyophilization, flush jet drying, flowing drying, and vibration type flowing drying are preferably used. Drying is conducted such that the moisture percentage of the final toner is about 1% by weight or less, and more preferably, about 0.7% by weight or less.

The inorganic particles and the organic particles may be externally added and mixed with the toner particle obtained in the above-described manner as flowability aids, cleaning aids, and abrasives and the like. Examples of the inorganic particles, all of which are usually used as the external additives on the surface of the toner, include silica, alumina, titanium oxide, calcium carbonate, magnesium carbonate, tricalcium phosphate, and cerium oxide. In regards to the inorganic particles, the surface thereof is preferably hydrophobized. The inorganic particles are used to control toner characteristics, such as chargeability, powder characteristics and storage stability, and system qualifications, such as developability and transferability. Examples of the organic particles, all of which are used as the external additives on the surface of the toner, include vinyl-based resins, such as styrene-based polymers, (meth)acryl-based polymers, ethylene-based polymers, polyester resin, silicone resin, and fluorine-based resin.

The particles are added to improve transferability, and the primary particle diameter is preferably in a range of from about 0.01 to about 0.5 μm. In addition, a lubricant may also be added. Examples of the lubricant include fatty acid amides, such as ethylene bisstearamide and oleamide, fatty acid metal salts, such as zinc stearate and calcium stearate, and higher alcohols, such as UNILIN. These are generally added to improve a cleaning effect, and the primary particle diameter thereof is in a range of from about 0.5 to about 8.0 μm.

At least two or more of the inorganic particles are used, at least one of the inorganic particles has an average primary particle diameter from about 30 nm to about 200 nm, and more preferably, from about 30 nm to about 180 nm. As the toner has a small particle diameter, a non-electrostatic adhesive force to the photoreceptor increases. Accordingly, defective transfer or image missing called hollow character may be caused, and may cause generation of a transfer unevenness or the like, when toner images are overlapped. Therefore, it is preferable to improve transferability by adding external additives having a large average primary particle diameter from about 30 nm to about 200 nm to the toner. If the average primary particle diameter is smaller than about 30 nm, initial toner flowability is good, however a non-electrostatic adhesive force between a toner and a photoreceptor may not be sufficiently reduced. For this reason, transfer efficiency may be degraded, and an increase in image missing and deterioration in uniformity of an image may be caused. In addition, particles may be buried in the surface of the toner due to a stress within a developing unit as time elapses, electrostatic property may be changed, and a problem, such as a reduction in density and fog on a background portion, may be caused in some cases. Furthermore, if the average primary particle diameter is larger than about 200 nm, the particles may be easily peeled from the surface of the toner, and flowability may be deteriorated in some cases.

Specifically, silica, alumina, and titanium oxide are preferably used. Hydrophobized silica is preferably added as an essential component. Silica and titanium oxide are preferably used together. In addition, the use of the organic particles having a particle diameter ranging from about 80 to about 500 nm enables improvement of the transferability. Examples of a hydrophobizing agent that hydrophobizes the external additives include known materials, for example, coupling agents, such as a silane-based coupling agent, a titanate-based coupling agent, an aluminate-based coupling agent, and a zirconium-based coupling agent, and silicone oil or known polymer.

The external additives are adhered or fixed to the surface of the toner by applying a mechanical impact using with a sample mill or a HENSCHEL mixer.

(Toner Characteristics)

In the exemplary embodiment of the invention, the volume-average particle diameter of the toner is preferably in a range of from about 4 to about 9 μm, more preferably, in a range of from about 4.5 to about 8.5 μm, and still more preferably, in a range of from about 5 to about 8 μm. If the volume-average particle diameter is smaller than about 4 μm, toner flowability is degraded, and particle chargeability is likely to be degraded or charge distribution becomes wide. Accordingly, fog on the background or toner spill from the developing unit or the like easily occurs. Furthermore, if the volume-average particle diameter is smaller than 4 μm, the cleaning effect may be deteriorated. If the volume-average particle diameter is larger than 9 μm, resolution may be degraded, a sufficient image quality may not be obtained, and it may be difficult to satisfy recent demands for high image quality.

In regards to the toner of the exemplary embodiment of the invention, a volume-average particle diameter distribution index (GSDv) that is determined by $(D84\%/D16\%)^{1/2}$ is preferably in a range of from about 1.15 to about 1.30, and more preferably, in a range of from about 1.15 to about 1.25. The D16% and the D84% are determined as follows. The particle diameter distribution determined as described below is plotted against the divided particle diameter range (channel) from the small diameter side to draw a cumulative distribution of volume. The particle diameter corresponding a cumulative 16% is defined as the volume D16%, the particle diameter corresponding to cumulative 50% is defined as the volume D50% and the particle diameter corresponding to cumulative 84% is defined as the volume D84%.

The measurements of the volume-average particle diameter may be conducted at an aperture diameter of 50 μm using a Multisizer II (manufactured by Beckman Coulter Inc.). At this time, the measurement is conducted after the toner is dispersed in an electrolyte solution (ISOTON solution) (concentration: 10% by weight), and then dispersed for 30 seconds or more by an ultrasonic wave. The particle diameter distribution is defined as follows. In a particle diameter range divided based on particle diameter distribution measured by Multisizer II (Division number: A range from 1.26 to 50.8 μm is divided into 16 channels at an interval of 0.1 based on log scale. Specifically, division is so conducted that particle diameter range of channel 1 is from 1.26 μm or more and less than 1.59 μm, that of channel 2 is from 1.59 μm or more and less than 2.00 μm, that of channel 3 is from 2.00 μm or more and less than 2.52 μm, and log values of the lower limits of respective channels are (log 1.26=) 0.1, (log 1.59=) 0.2, (log 2.00=) 0.3, . . . 1.6), cumulative distributions of volume and number are drawn from the smaller diameter side, and the particle diameters at a cumulation of 16% are defined as volume $D_{16V}$, and number $D_{16P}$, the particle diameters at a cumulation of 50% are defined as volume $D_{50V}$ (volume-average particle diameter), and number $D_{50P}$, and the particle diameters at a cumulation of 84% are defined as volume $D_{84V}$, and number $D_{84P}$.

In the toner of the exemplary embodiment of the invention, the shape factor SF1 is preferably in a range of from about 110 to about 145, that is, in a sphere form. If the shape is in a sphere form within the range, transfer efficiency and image elaborateness can be improved, and a high quality image can be formed.

The shape factor SF1 is preferably in a range of from about 110 to about 135.

Here, the shape factor SF1 is determined by Formula (1).

$$SF1=(ML^2/A)\times(\pi/4)\times100 \quad \text{Formula (1)}$$

In Formula (1), ML represents an absolute maximum length of the toner particle, and A represents a projected area of the toner particle.

SF1 is numerically expressed by analyzing a microscope image or a scanning electron microscope (SEM) image using an image analyzer. For example, SF1 can be calculated as follows. That is, calculation of SF1 is conducted by loading an optical microscope image of the toner particles dispersed on the surface of slide glass into a Luzex image analyzer through a video camera, then measuring the maximum length and the projected area for 100 particles, calculating SF1 of each particle according to Formula (1), and subsequently calculating the average value thereof.

In the exemplary embodiment of the invention, the content of titanium in a crystalline resin component of chloroform-soluble components of the toner is preferably in a range of from about 10 ppm to about 500 ppm according to high-frequency inductively coupled plasma emission spectrometry. In addition, the content of tin in an amorphous resin component of chloroform-soluble components of the toner is preferably in a range of from about 50 ppm to about 1500 ppm according to high-frequency inductively coupled plasma emission spectrometry.

The content of titanium and the content of tin in the amorphous polyester resin and the crystalline polyester resin among the components of the toner are obtained by the following method.

The crystalline resin and the amorphous resin in the toner are separated from each other. First, the toner is left in a constant temperature bath at temperature 50° C. and humidity 55 RH % for 24 hours, and a heat history of the toner is cancelled. Next, 10 g of the toner is dissolved in 100 g of methyl ethyl ketone (MEK) at normal temperature (20 to 25° C). This is because, when the crystalline resin and the amorphous resin are contained in the toner, only the amorphous resin is dissolved in MEK at the normal temperature. Accordingly, since the amorphous resin including the amorphous polyester resin is contained in the MEK-soluble component, amorphous polyester resin is obtained from a supernatant liquid centrifuged by centrifugation (a centrifugal separator (trade name: 'H-18', manufactured by Kokusan Co., Ltd.), at 2500 rpm for 15 minutes) after being dissolved. MEK, in which the amorphous resin is dissolved, is removed by a vacuum drier, thereby obtaining the amorphous resin. The solid component after centrifugation is dissolved in 100 g of MEK and centrifuged again, and a supernatant is discarded. Meanwhile, the solid component after centrifugation is dissolved in 100 g of MEK while being heated at 70° C. and then centrifuged. Then, the crystalline polyester resin is obtained from the centrifuged supernatant liquid. For both resins obtained in the above-described manner, the content of tin and the content of titanium can be confirmed by the above-described method.

If the content of titanium is less than about 10 ppm, compatibility of the crystalline resin and the amorphous resin may be insufficient, or image glossiness under the above-described fixing conditions may be lacking. If the content of titanium exceeds about 500 ppm, charging environmental stability may be deteriorated due to the remaining titanium, for example, the crystalline resin is easily exposed from the surface of the toner.

The content of titanium is more preferably in a range of from about 30 to about 200 ppm.

If the content of tin is less than about 50 ppm, toner aggregation for manufacturing may be deteriorated, and thus fine power may be increased. If the content of tin exceeds about 1500 ppm, charging environmental stability may be deteriorated due to the remaining tin.

The content of tin is more preferably in a range of from about 100 to about 1000 ppm. Moreover, a detailed measurement method by ICP spectroanalysis will be described below.

In the toner of the exemplary embodiment of the invention, the charge amount in an absolute value is preferably in a range of from about 15 to about 70 μC/g, and more preferably, in a range of from about 20 to about 50 μC/g. If the charge amount is less than about 15 μC/g, stains may easily occur on the background. Meanwhile, if the charge amount exceeds about 70 μC/g, image density may be likely to be degraded. In addition, a ratio (HH/LL) between the charge amount under a high temperature and high humidity environment (HH) of 30° C. and 80 RH % and the charge amount under a low temperature and low humidity environment (LL) of 10° C. and 20 RH % is preferably in a range of from about 0.5 to about 1.5, and more preferably, in a range of from about 0.7 to about 1.2. If the ratio falls within the range, a vivid image can be obtained without being affected by the environment.

In the toner of the exemplary embodiment of the invention, a tetrahydrofuran (hereinafter, referred to as 'THF')-insoluble component is preferably about 10% by weight or less based on the binder resin components. If the amount of the THF-insoluble component is large, offset resistance is improved, however image glossiness may be damaged and OHP light transparency may be damaged.

Measurement of the THF-insoluble component is conducted by dissolving the resin in THF with a concentration of 5% by weight while heating in a hot-water bath at 60° C., filtering with a membrane filter or the like, drying the remainder on the filter, and measuring the weight.

<Electrostatic Image Developer>

The electrostatic image developing toner of the exemplary embodiment of the invention may be used as it is as a one-component developer or as a two-component developer including a carrier. The two-component developer having excellent charging preservability or stability is preferable.

As the carrier, a resin-coated carrier is preferably used. In addition, a nitrogen-containing resin-coated carrier is more preferably used. Examples of the nitrogen-containing resin include acryl-based resins containing dimethylaminoethyl methacrylate, dimethyl acrylamide, and acrylonitrile, amino resins containing urea, urethane, melamine, guanamine, and aniline, amide resins, and urethane resins. Alternatively, copolymerized resins thereof may be used. As the carrier coating resin, two or more of the nitrogen-containing resins may be used in combination. In addition, the nitrogen-containing resin and a resin not containing nitrogen may be used in combination. Furthermore, the nitrogen-containing resin may be finely divided and dispersed in a resin not containing nitrogen. Particularly, since urea resin, urethane resin, melamine resin, amide resin have high negative chargeability and high hardness, the charge amount can be effectively prevented from being decreased when the resin coating layer is separated.

Generally, the carrier needs to have appropriate electrical resistance. Specifically, electrical resistance of from about $10^9$ to about $10^{14}$ Ωcm is needed. For example, in a carrier formed of iron power, when electrical resistance is low, for example, about $10^6$ Ωcm, various problems may arise, including adhesion of the carrier to the image portion of the photoreceptor due to charge injection from the sleeve, or loss of the latent image charge through the carrier, which may cause disorder in the latent image and image defects and the like. Meanwhile, if insulating resin (volume resistivity is about $10^{14}$ Ωcm or more) is coated thick, electrical resistance becomes too high, and the carrier charge rarely leaks. As a result, an edge effect occurs, that is, although the edge of the image is crisp, the central portion of the image with a large area suffers from extremely poor image density. For this reason, for adjustment of resistance of the carrier, conductive powder is preferably dispersed in the resin coating layer.

Specific examples of the conductive powder include metals, such as gold, silver, and copper; carbon black; semiconductive oxides, such as titanium oxide and zinc oxide; composite systems in which particles of titanium oxide, zinc oxide, barium sulfate, aluminum borate, and potassium titanate are surface-coated with tin oxide, carbon black or metal. In view of production stability, cost, and good conductivity, carbon black is particularly desirable.

Examples of the method of forming the resin coating layer on the surface of the carrier core material include an immersion method in which powder of the carrier core material is immersed within a coating layer-forming solution, a spray method in which a coating layer-forming solution is sprayed onto the surface of the carrier core material, a fluidized bed method in which a coating layer-forming solution is sprayed while the carrier core material is maintained in a floating state using an air flow, a kneader coater method in which the carrier core material and a coating layer-forming solution are mixed together in a kneader coater and the solvent is subsequently removed, and a powder coating method in which the coating resin is converted to fine particles, and is then mixed with the carrier core material in a kneader coater at a temperature higher than the melting temperature of the coating resin, and subsequently cooled. Of these, the use of the kneader coater method and the powder coating method is particularly preferable. The average thickness of the resin coating layer is usually in a range of from about 0.1 to about 10 μm, and more preferably, in a range of from about 0.2 to about 5 μm.

The core material (that is, the carrier core material) used in the carrier is not particularly limited. Examples of the core material include magnetic metals, such as iron, steel, nickel, and cobalt, magnetic oxides, such as ferrite and magnetite, and glass beads. When the magnetic brush method is used, a magnetic carrier is desirable. The average particle diameter of the carrier core material is generally in a range of from about 10 to about 100 μm, and more preferably, in a range of from about 20 to about 80 μm.

In the above-described two-component developer, the mixing ratio (weight ratio) between the toner and the carrier is preferably in a range of approximately toner:carrier=about 1:100 to about 30:100, and more preferably, in a range of approximately about 3:100 to about 20:100.

<Image Forming Apparatus>

Next, an image forming apparatus of an exemplary embodiment of the invention that uses the electrostatic image developing toner of the exemplary embodiment of the invention will be described.

An image forming apparatus of an exemplary embodiment of the invention includes an image holding member; a developing unit that develops an electrostatic image formed on the image holding member as a toner image using the electrostatic image developer according to the exemplary embodiment of the invention; a transfer unit that transfers the toner image formed on the image holding member to an image receiving member; and a fixing unit that fixes the toner image transferred to the image receiving member.

In the image forming apparatus, a portion including the developing unit may have a cartridge structure (process cartridge) that is detachably mounted on the main body of the image forming apparatus. As the process cartridge, a process cartridge including at least a developer holding member and having the electrostatic image developer according to the exemplary embodiment of the invention contained in the process cartridge is suitably used.

Hereinafter, an example of the image forming apparatus of the exemplary embodiment of the invention is described, however the exemplary embodiment of the invention is not limited thereto. Moreover, only the main parts shown in the drawings will be described, and the descriptions of other parts will be omitted.

FIG. 1 is a diagram showing the schematic configuration of a four-drum tandem-type full color image forming apparatus. The image forming apparatus shown in FIG. 1 includes electrophotographic first to fourth image forming units 10Y, 10M, 10C, and 10K (image forming unit) that output images for yellow (Y), magenta (M), cyan (C), and black (K) on the basis of image data subjected to color separation, respectively. The image forming units (hereinafter, simply referred to as 'unit') 10Y, 10M, 10C, and 10K are arranged in a horizontal direction at predetermined intervals. Moreover, the units 10Y, 10M, 10C, and 10K may be a process cartridge that is detachably mounted on the main body of the image forming apparatus.

Above the units 10Y, 10M, 10C, and 10K in the drawing, an intermediate transfer belt 20 as an intermediate transfer member extends over the units. The intermediate transfer belt 20 is wound around a driving roller 22 and a support roller 24, which are arranged apart from each other in the horizontal direction of the drawing, and the support roller 24 comes into contact with the inner surface of the intermediate transfer belt 20. The intermediate transfer belt 20 travels in a direction from the first unit 10Y toward the fourth unit 10K. Moreover, the support roller 24 is urged by a spring and the like (not shown) in a direction distant from the driving roller 22, such that predetermined tension is applied to the intermediate transfer belt 20 wound around both rollers. Furthermore, an intermediate transfer member cleaning device 30 is provided to face the driving roller 22 at a side of the image holding member of the intermediate transfer belt 20.

Developing devices (developing units) 4Y, 4M, 4C, 4K corresponding to the units 10Y, 10M, 10C, and 10K are supplied with toners of four colors of yellow, magenta, cyan, and black, which are contained in toner cartridges 8Y, 8M, 8C, and 8K, respectively.

The first to fourth units 10Y, 10M, 10C, and 10K have the same configuration, and thus a description will be given for the first unit 10Y that is provided on an upstream side in the travel direction of the intermediate transfer belt to form a yellow image. Moreover, the same parts as those of the first unit 10Y are represented by the same reference numerals but having different labels magenta (M), cyan (C), and black (K), instead of yellow (Y), and the descriptions of the second to fourth units 10M, 10C, and 10K will be omitted.

The first unit 10Y has a photoreceptor 1Y that functions as the image holding member. Around the photoreceptor 1Y are sequentially arranged a charging roller 2Y that charges the surface of the photoreceptor 1Y at a predetermined potential, an exposure device 3 that exposes the charged surface to a laser beam 3Y on the basis of an image signal subjected to color separation, to thereby form an electrostatic image, a developing device (developing unit) 4Y that supplies a charged toner to the electrostatic image and develops the electrostatic image, and a primary transfer roller 5Y (primary transfer unit) that transfers the developed toner image to the intermediate transfer belt 20, and a photoreceptor cleaning device (cleaning unit) 6Y that removes the toner remaining on the surface of the photoreceptor 1Y after primary transfer.

The primary transfer roller 5Y is disposed inside the intermediate transfer belt 20, and is provided to face the photoreceptor 1Y. In addition, each of the primary transfer rollers 5Y, 5M, 5C, and 5K is connected to a primary bias power source (not shown) and is applied with a primary transfer bias therefrom. The bias power source changes the transfer bias to be applied to the corresponding primary transfer roller under the control of a control unit (not shown).

Hereinafter, the operation of the first unit 10Y to form the yellow image will be described. First, before the operation, the charging roller 2Y charges the surface of the photoreceptor 1Y at a potential of from about −600 V to about −800 V.

The photoreceptor 1Y is formed by laminating a photosensitive layer on a conductive base substance (volume resistivity: about $1\times10^{-6}$ Ωcm or less at 20° C). The photosensitive layer usually has high resistance (resistance corresponding to general resin), however if the laser beam 3Y is irradiated, resistivity of a portion irradiated with the laser beam varies. The laser beam 3Y is output to the charged surface of the photoreceptor 1Y through the exposure device 3 according to image data for yellow from the control unit (not shown). The laser beam 3Y is irradiated onto the photosensitive layer on the surface of the photoreceptor 1Y, and accordingly, an electrostatic image having a yellow print pattern is formed on the surface of the photoreceptor 1Y.

The electrostatic image is an image that is formed on the surface of the photoreceptor 1Y by charging. Specifically, the electrostatic image is a so-called negative latent image that is formed as follows: the resistivity of an irradiated portion of the photosensitive layer is decreased by the laser beam 3Y, a charge on the surface of the photoreceptor 1Y flows while a charge in a portion not irradiated with the laser beam 3Y remains.

The electrostatic image formed on the photoreceptor 1Y in this manner is rotated to a predetermined development position as the photoreceptor 1Y travels. Then, at that development position, the electrostatic image on the photoreceptor 1Y becomes a visual image (developed image) by the developing device 4Y.

In the developing device 4Y, for example, a yellow toner that contains at least a yellow colorant, crystalline resin, and amorphous resin and has a volume-average particle diameter of about 7 μm is contained. The yellow toner is stirred in the developing device 4Y and frictionally charged, and is held on a developer roller (developer holding member) with a charge having the same polarity (negative) as the charge on the photoreceptor 1Y. Then, when the surface of the photoreceptor 1Y passes through the developing device 4Y, the yellow toner is electrostatically adhered to a neutralized latent image portion on the surface of the photoreceptor 1Y, and the latent image is developed by the yellow toner. The photoreceptor 1Y, on which the yellow toner image is formed, travels at a predetermined speed, and then the toner image developed on the photoreceptor 1Y is transferred to a predetermined primary transfer position.

If the yellow toner image on the photoreceptor 1Y is transferred to the primary transfer position, a predetermined primary transfer bias is applied to the primary transfer roller 5Y. Next, an electrostatic force from the photoreceptor 1Y toward the primary transfer roller 5Y acts on the toner image, and then the toner image on the photoreceptor 1Y is transferred to the intermediate transfer belt 20. At this time, the applied transfer bias has a positive (+) polarity opposite to the polarity (−) of the toner. Here, the transfer bias of the first unit 10Y is controlled at approximately +10 μA by the control unit (not shown).

Meanwhile, the toner that remains on the photoreceptor 1Y is removed by the cleaning device 6Y and collected.

The primary transfer bias that is applied to the primary transfer rollers 5M, 5C, and 5K of the second unit 10M and later is controlled in the same manner as in the first unit.

In this manner, the intermediate transfer belt 20, to which the yellow toner,image is transferred by the first unit 10Y, sequentially passes through the second to fourth units 10M, 10C, and 10K, such that the toner images for the individual colors are superposed and multiple transferred.

The intermediate transfer belt 20, to which the toner images for four colors are multiple transferred through the first to fourth units reaches a secondary transfer section. The secondary transfer section includes the intermediate transfer belt 20, the support roller 24 that comes into contact with the inner surface of the intermediate transfer belt 20, and a secondary transfer roller (secondary transfer unit) 26 that is arranged at a side of the image holding surface of the intermediate transfer belt 20. Meanwhile, a recording paper (image receiving member) P is supplied to a gap between the secondary transfer roller 26 and the intermediate transfer belt 20 through a paper feed mechanism at a predetermined timing, and a predetermined secondary transfer bias is applied to the support roller 24. At this time, the applied transfer bias has a negative (−) polarity identical to the polarity (−) of the toner. An electrostatic force from the intermediate transfer belt 20 toward the recording paper P acts on the toner image, and the toner image on the intermediate transfer belt 20 is transferred to the recording paper P. Moreover, the secondary transfer bias is determined depending on resistance detected by a resistance detection unit (not shown) of the second transfer section, and the voltage of the secondary transfer bias is controlled.

Subsequently, the recording paper P is forwarded to the fixing device (fixing unit) 28, the toner image is heated, and the color-superposed toner image is molten and fixed on the recording paper P. The recording paper P, on which a color image is fixed, is sent toward a discharge section, and then the color image forming operation is completed.

Moreover, in the above-described image forming apparatus, the toner image is transferred to the recording paper P through the intermediate transfer belt 20. However, the exemplary embodiment of the invention is not limited thereto. For example, the toner image may be directly transferred from the photoreceptor to the recording paper.

<Process Cartridge and Toner Cartridge>

Figure 2:
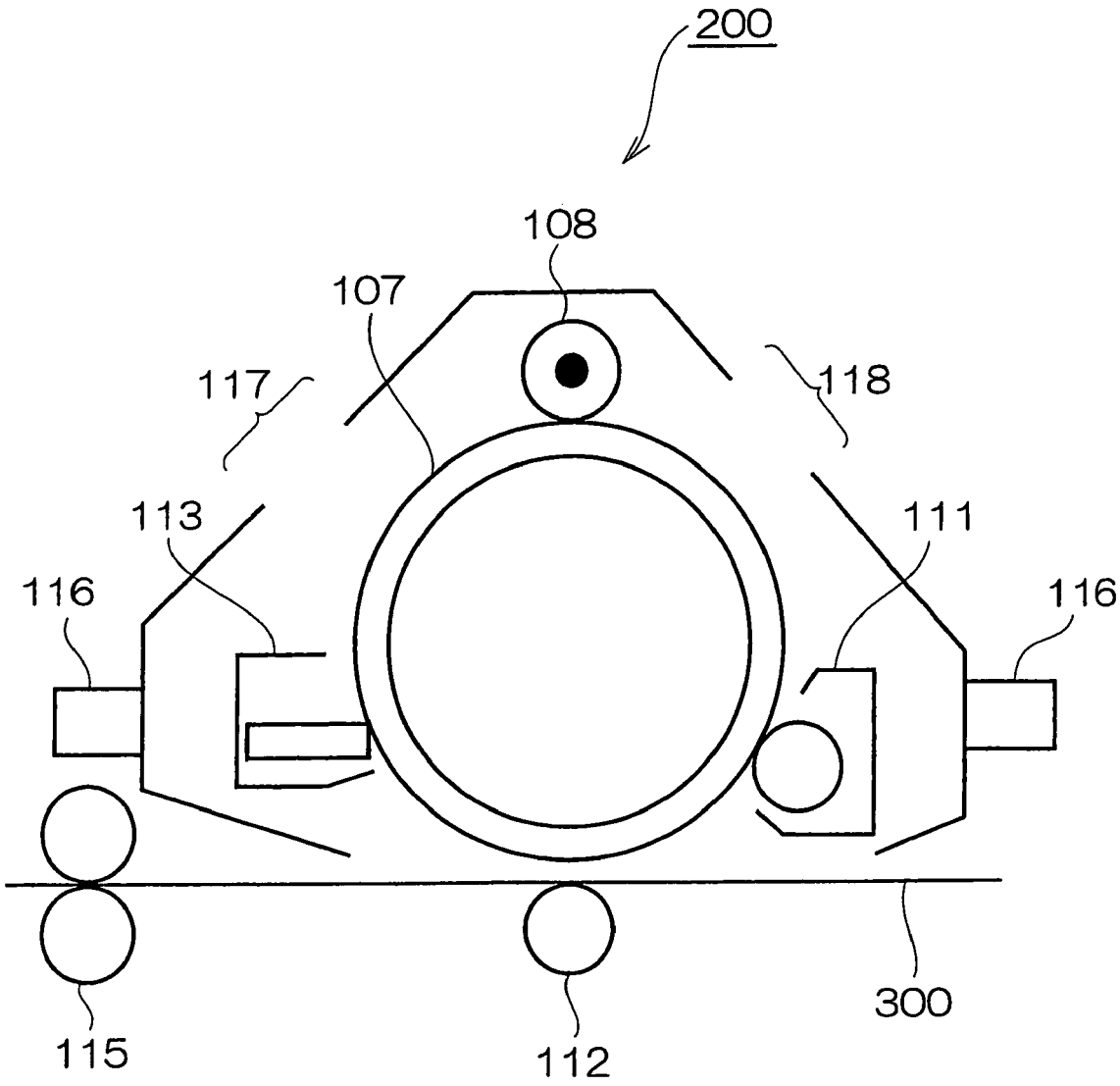
FIG. 2 is a diagram showing the schematic configuration of a process cartridge according to an exemplary embodiment of the invention.

FIG. 2 is a diagram showing the schematic configuration of a preferred example of a process cartridge that contains the electrostatic image developer of the exemplary embodiment of the invention. A process cartridge 200 assembles a charging device 108, a developing device 111, a photoreceptor cleaning device (cleaning unit) 113, an opening 118 for exposure, and an opening 117 for neutralization exposure using a mounting rail 116 as a single body, together with the photoreceptor 107.

The process cartridge 200 is detachable with respect to the main body of the image forming apparatus including a transfer device 112, a fixing device 115, and other components (not shown). The process cartridge 200 constitutes the image forming apparatus together with the main body of the image forming apparatus. Moreover, reference numeral 300 denotes a recording paper.

The process cartridge shown in FIG. 2 includes the charging device 108, the developing device 111, the cleaning device (cleaning unit) 113, the opening 118 for exposure, and the opening 117 for neutralization exposure. However, these devices may be selectively combined. The process cartridge of the exemplary embodiment of the invention includes the photoreceptor 107, and at least one of the charging device 108, the developing device 111, the cleaning device (cleaning unit) 113, the opening 118 for exposure, and the opening 117 for neutralization exposure.

Next, a toner cartridge according to an exemplary embodiment of the invention will be described. The toner cartridge according to an exemplary embodiment of the invention contains at least the electrostatic image developing toner according to the exemplary embodiment of the invention. The toner cartridge of the exemplary embodiment of the invention is preferably a toner cartridge that is detachably mounted on the image forming apparatus, and contains at least a toner of the exemplary embodiment of the invention to be supplied to a developing unit in the image forming apparatus. Moreover, the toner cartridge of the exemplary embodiment of the invention may contain at least a toner, or may contain a developer according to the configuration of the image forming apparatus.

Accordingly, in an image forming apparatus, on which the toner cartridge is detachable mounted, the toner cartridge that contains the toner of the exemplary embodiment of the invention can be used. Accordingly, in a compact toner cartridge, storage stability can be ensured, and low-temperature fixing can be achieved while maintaining high image quality.

The image forming apparatus shown in FIG. 1 has the configuration on which the toner cartridges 8Y, 8M, 8C, and 8K are detachable mounted, and the developing devices 4Y, 4M, 4C, and 4K are correspondingly connected to the toner cartridges through toner supply lines (not shown). Furthermore, when the toner contained in the toner cartridge is used up, the toner cartridge can be replaced.

All publication, patent applications, and technical standards mentioned in this specification are herein incorporated by reference to the same extent as if each individual publication, patent application, or technical standard was specifically and individually indicated to be incorporated by reference.

The foregoing description of the exemplary embodiments of the present invention has been provided for the purposes of illustration and description. It is not limited to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

EXAMPLES

Hereinafter, the present invention will be described in detail by way of Examples, but the invention is not limited to Examples.

In this example, the toner is obtained in the following manner. First, a resin dispersion, a colorant dispersion, and a releasing agent dispersion described below are prepared. Next, they are mixed at a predetermined amount and stirred, and a metal salt flocculant is added to the mixture, and the mixture is ionically neutralized, thereby forming aggregate particles including the resin, the colorant and the releasing agent. Subsequently, pH in the system is adjusted from mild acidity to neutrality by an inorganic hydroxide, and then heating is conducted at a temperature above the glass transition temperature of the resin particle (or above the melting temperature), to thereby fuse and coalesce the particles. After the reaction is completed, sufficient washing, solid-liquid separation, and drying are conducted, and desired toner particles are obtained. Hereinafter, a description will be given based on the above descriptions.

<Method of Measuring Various Characteristics>

First, a method of measuring the properties of the toner and others used Examples and Comparative Examples will be described. Moreover, the descriptions that have been already described above will be completely or partially omitted.

(Method of Measuring Molecular Weight and Molecular Weight Distribution of Resin)

In the invention, the molecular weight and the molecular weight distribution of the crystalline polyester resin and others are measured by the GPC using 'HLC-8120GPC and SC-8020 (manufactured by Tosoh Corporation) devices' under the above-described conditions.

(Volume-Average Particle Diameter of Resin Particle or Colorant Particle or Others)

The volume-average particle diameter of the resin particle or colorant particle or the like is measured by a Doppler scattering particle diameter distribution analyzer (trade name: Microtrack UPA9340, manufactured by Nikkiso Co., Ltd.).

(Method of Measuring Melting Temperature and Glass Transition Temperature of Resin)

The melting temperature of crystalline resin and the glass transition temperature Tg of amorphous resin are measured using a differential scanning calorimeter (trade name: DSC3110, manufactured by Mac Science Co., Ltd., thermal analysis system 001) based on ASTM D3418-8 under the above-described conditions. Moreover, the melting temperature is set as the endothermic peak, and the glass transition temperature is set as a temperate at an intermediate temperature in a stepwise change in endothermic quantity.

(Content of Titanium and Tin in Toner)

The dried substance of the crystalline resin or the amorphous resin separated from the toner in the above-described manner is weighed in an amount of 250.0 mg by a balance (trade name: AT-200, manufactured by Mettler-Toledo K. K.), which can weigh 0.01 mg, put in a 25 ml measuring flask, and is dissolved with 20 ml of chloroform. When dissolution is difficult, the mixture is heated and dissolved in a hot-water bath at 50° C.

After dissolution, chloroform is added to a gauge line of the measuring flask to dilute the mixture and a sample is prepared. Under the conditions including grating: main spectrometer 3600 pieces/mm, slit: incoming 20 μm and outgoing 40 μm, photo multiplier: R306, torch: torch for organic solvent, nebulizer: glass concentric, argon gas flow rate: plasma gas 18 liter/minute, auxiliary gas 1.8 liter/minute, carrier gas 0.11 MPa, RF power: 1.8 kW, analysis wavelength: 334.9 nm (Ti), 242.949 nm (Sn), photometric height: 20 mm (Ti), 23 mm (Sn), and integral time: 1 second, integration times three times, Metallo-Organic Standard (5000 μg/g) (manufactured by Conostan) is used as a titanium standard solution, and a tin standard solution is prepared using dibutyl tin dilaurate, the content of titanium and tin is measured using a high-frequency inductively coupled plasma emission spectrometry device (ICP-AES) (trade name: SPS1200VR, manufactured by Seiko Electronics Inc.).

<Dispersions Preparation>

(Amorphous Polyester Resin Dispersion (1))

bisphenol A propylene oxide adduct (trade name: Newpole BP-2P, manufactured by Sanyo Chemical Industries, Ltd.): 100 mol % terephthalic acid: 70 mol % dodecenyl succinic acid: 22 mol % trimellitic anhydride: 3 mol %

A monomer, excluding trimellitic anhydride, among the monomers, and tin dioctanoate are put in a reaction vessel in an amount of 0.17 parts by weight with respect to 100 parts by weight of the monomer. The reaction vessel includes a stirring device, a thermometer, a condenser, and a nitrogen gas introduction line. The reaction is conducted at 235° C. for 6 hours under a nitrogen gas flow, and then the temperature falls to 190° C. Next, the trimellitic anhydride is put in, and the reaction is conducted for 1 hour. Furthermore, the temperature rises to 220° C. within 4 hours, and polymerization is conducted at a pressure of 10 kPa until a desired molecular weight is obtained, thereby obtaining light yellow and transparent amorphous polyester resin (1). The glass transition temperature (Tg) of the amorphous polyester resin (1) by the DSC is 57° C., Mw by the GPC is 53000, Mn is 7800, the softening temperature by a flow tester is 120° C., the acid value is 14 mgKOH/g, and the SP value calculated by the Fedors method is 20.7 $(J/cm^3)^{1/2}$.

A mixed solvent of ethyl acetate and isopropyl alcohol is put in a 5 L separable flask in an amount just enough to dissolve resin, then the resin is gradually put therein, stirring is conducted by Three-one motor such that the resin is dissolved, thereby obtaining an oil phase. Next, a diluted ammonia solution is dropped into the stirred oil phase in an appropriate amount, and ion-exchanged water is also dropped to conduct phase-inversion emulsion. Next, the solvent is removed while the pressure is reduced by an evaporator, thereby obtaining an amorphous polyester resin dispersion (1). In this dispersion, the volume-average particle diameter of the resin particle is 150 nm. Subsequently, with adjustment using ion-exchanged water, the concentration of the solid component is set to 20% by weight.

(Amorphous Polyester Resin Dispersion (2))

Light yellow and transparent amorphous polyester resin (2) is obtained in the same manner as for synthesis of the amorphous polyester resin (1), except that tin dioctanoate is substituted with 0.35 parts by weight of titanium tetrabutoxide as the polymerization catalyst. The glass transition temperature (Tg) of the amorphous polyester resin (2) by the DSC is 56° C., Mw by the GPC is 50000, Mn is 6800, the acid value is 15 mgKOH/g, and the SP value calculated by the Fedors method is 20.7 $(J/cm^3)^{1/2}$.

An amorphous polyester resin dispersion (2) is obtained using the amorphous polyester resin (2) in the same manner as in the preparation of the amorphous polyester resin dispersion (1).

In this dispersion, the volume-average particle diameter of the resin particle is 140 nm. Subsequently, with the adjustment using ion-exchanged water, the concentration of the solid component is set to 20% by weight.

(Amorphous Polyester Resin Dispersion (3))

bisphenol A propylene oxide adduct (trade name: Newpole BP-2P, manufactured by Sanyo Chemical Industries, Ltd.): 100 mol % terephthalic acid: 68 mol % dodecenyl succinic anhydride: 20 mol % trimellitic anhydride: 3 mol %

A monomer, excluding trimellitic anhydride, among the monomers, and tin dioctanoate are put in a reaction vessel in an amount of 0.16 parts by weight with respect to 100 parts by weight of the monomer. The reaction vessel includes a stirring device, a thermometer, a condenser, and a nitrogen gas introduction line. The reaction is conducted at 235° C. for 6 hours under a nitrogen gas flow, and then the temperature falls to 190° C. Next, the trimellitic anhydride is put in, and the reaction is conducted for 1 hour. Furthermore, the temperature rises to 220° C. within 4 hours, and polymerization is conducted at a pressure of 10 kPa until a desired molecular weight is obtained, thereby obtaining light yellow and transparent amorphous polyester resin (3). The glass transition temperature (Tg) of the amorphous polyester resin (3) by the DSC is 56° C., Mw by the GPC is 51000, Mn is 7300, the softening temperature by the flow tester is 118° C., the acid value is 9.1 mgKOH/g, and the SP value calculated by the Fedors method is 20.8 $(J/cm^3)^{1/2}$.

An amorphous polyester resin dispersion (3) is obtained using the amorphous polyester resin (3) in the same manner as the preparation of the amorphous polyester resin dispersion (1).

In this dispersion, the volume-average particle diameter of the resin particle is 180 nm. Subsequently, with adjustment using ion-exchanged water, the concentration of the solid component is set to 20% by weight.

(Amorphous Polyester Resin Dispersion (4))

bisphenol A propylene oxide adduct (trade name: Newpole BP-2P, manufactured by Sanyo Chemical Industries, Ltd.): 100 mol % terephthalic acid: 68 mol % dodecenyl succinic anhydride: 25 mol % trimellitic anhydride: 3 mol %

A monomer, excluding trimellitic anhydride, among the monomers, and tin dioctanoate are put in a reaction vessel in an amount of 0.75 parts by weight with respect to 100 parts by weight of the monomer. The reaction vessel includes a stirring device, a thermometer, a condenser, and a nitrogen gas introduction line. The reaction is conducted at 235° C. for 6 hours under a nitrogen gas flow, and then the temperature falls to 190° C. Next, the trimellitic anhydride is put in, and the reaction is conducted for 1 hour. Furthermore, the temperature rises to 220° C. within 4 hours, and polymerization is conducted at a pressure of 10 kPa until a desired molecular weight is obtained, thereby obtaining light yellow and transparent amorphous polyester resin (4). The glass transition temperature (Tg) of the amorphous polyester resin (4) by the DSC is 55° C., Mw by the GPC is 57000, Mn is 7100, the softening temperature by the flow tester is 121° C., the acid value is 16.2 mgKOH/g, and the SP value calculated by the Fedors method is 20.6 $(J/cm^3)^{1/2}$.

An amorphous polyester resin dispersion (4) is obtained using the amorphous polyester resin (4) in the same manner as in the preparation of the amorphous polyester resin dispersion (1).

In this dispersion, the volume-average particle diameter of the resin particle is 130 nm. Subsequently, with adjustment using ion-exchanged water, the concentration of the solid component is set to 20% by weight.

(Crystalline Polyester Resin Dispersion (1))

1,8-octane dicarboxylic acid (reagent): 100 mol %

1,9-nonanediol (reagent): 100 mol %

The above components are put in a reaction vessel, and the reaction vessel is substituted with a drying nitrogen gas. The reaction vessel includes a stirring device, a thermometer, a condenser, and a nitrogen gas introduction line. Next, titanium tetrabutoxide (reagent) is put therein in an amount of 0.25 parts by weight with respect to 100 parts by weight of the monomer, and stirring is conducted at 170° C. for 10 hours under a nitrogen gas flow. Furthermore, the temperature rises to 220° C., the pressure in the reaction vessel is reduced to 3 kPa, and stirring is conducted for 10 hours under a reduced pressure, thereby obtaining crystalline polyester resin (1). The melting temperature of the crystalline polyester resin (1) by the DSC is 70.5° C., Mw by the GPC is 23000, Mn is 9000, the acid value is 9.8 mgKOH/g, and the SP value calculated by the Fedors method is 18.6 $(J/cm^3)^{1/2}$.

200 parts by weight of the crystalline polyester resin (1) is put in 800 parts by weight of distilled water, and heating is conducted at 85° C. Next, pH is adjusted to 9.0 using ammonia, and an anionic surfactant (trade name: Neogen RK, manufactured by Dai-ichi Kogyo Seiyaku Co., Ltd.) is added in an amount of 0.4 parts by weight (as effective component). Next, while heating is conducted at 85° C., dispersion is conducted at 8000 rpm for 5 minutes using a homogenizer (trade name: Ultra Turrax T-50, manufactured by IKA Japan K.K.). Furthermore, dispersion is conducted at 110° C. by the amount corresponding to 10 pass using a pressure discharge type Gaulin homogenizer, thereby obtaining a crystalline polyester resin dispersion (1). In this dispersion, the volume-average particle diameter of the particle is 220 nm, and the solid component is 20% by weight.

(Crystalline Polyester Resin Dispersion (2))

Crystalline polyester resin (2) is obtained in the same manner as in the synthesis of the crystalline polyester resin (1), except that titanium tetrabutoxide is substituted with 0.15 parts by weight of tin dioctanoate as the polymerization catalyst. The melting temperature of the crystalline polyester resin (2) by the DSC is 70.7° C., Mw by the GPC is 26000, Mn is 10000, the acid value is 8.9 mgKOH/g, and the SP value calculated by the Fedors method is 18.6 $(J/cm^3)^{1/2}$.

A crystalline polyester resin dispersion (2) is obtained using the crystalline polyester resin (2) in the same manner as in the preparation of the crystalline polyester resin dispersion (1).

(Crystalline Polyester Resin Dispersion (3))

1,8-octane dicarboxylic acid (reagent): 100 mol %

1,9-nonane diol (reagent): 100 mol %

The above components are put in a reaction vessel, and the reaction vessel is substituted with a drying nitrogen gas. The reaction vessel includes a stirring device, a thermometer, a condenser, and a nitrogen gas introduction line. Next, titanium tetrabutoxide (reagent) is put therein in an amount of 1.1 parts by weight with respect to 100 parts by weight of the monomer, and stirring is conducted at 170° C. for 10 hours under a nitrogen gas flow. Furthermore, the temperature rises to 220° C., the pressure in the reaction vessel is reduced to 3 kPa, and stirring is conducted for 10 hours under a reduced pressure, thereby obtaining crystalline polyester resin (3). The melting temperature of the crystalline polyester resin (3) by the DSC is 69.9° C., Mw by the GPC is 24000, Mn is 8000, the acid value is 10.6 mgKOH/g, and the SP value calculated by the Fedors method is 18.6 $(J/cm^3)^{1/2}$.

A crystalline polyester resin dispersion (3) is obtained using the crystalline polyester resin (3) in the same manner as in the preparation of the crystalline polyester resin dispersion (1).

(Addition Particle Dispersion (1))

An anionic surfactant (trade name: Neogen RK, manufactured by Dai-ichi Kogyo Seiyaku Co., Ltd., the amount of effective component: 60% by weight) is added and mixed with 210 parts by weight of the amorphous polyester resin dispersion (1), such that the amount becomes 2% by weight with respect to the resin solid component. Subsequently, pH is adjusted 3.0 using 2% by weight of a nitric acid aqueous solution, thereby preparing an addition particle dispersion (1).

(Addition Particle Dispersion (2))

An anionic surfactant (trade name: Neogen RK, manufactured by Dai-ichi Kogyo Seiyaku Co., Ltd., the amount of effective component: 60% by weight) is added and mixed with 210 parts by weight of the amorphous polyester resin dispersion (2), such that the amount becomes 2% by weight with respect to the resin solid component. Subsequently, pH is adjusted to 3.0 using 2% by weight of a nitric acid aqueous solution, thereby preparing an addition particle dispersion (2).

(Addition Particle Dispersion (3))

An anionic surfactant (trade name: Neogen RK, manufactured by Dai-ichi Kogyo Seiyaku Co., Ltd., the amount of effective component: 60% by weight) is added and mixed with 210 parts by weight of the amorphous polyester resin dispersion (3), such that the amount becomes 2% by weight with respect to the resin solid component. Subsequently, pH is adjusted to 3.0 using 2% by weight of a nitric acid aqueous solution, thereby preparing an addition particle dispersion (3).

(Addition Particle Dispersion (4))

An anionic surfactant (trade name: Neogen RK, manufactured by Dai-ichi Kogyo Seiyaku Co., Ltd., the amount of effective component: 60% by weight) is added and mixed with 210 parts by weight of the amorphous polyester resin dispersion (4), such that the amount becomes 2% by weight with respect to the resin solid component. Subsequently, pH is adjusted to 3.0 using 2% by weight of a nitric acid aqueous solution, thereby preparing an addition particle dispersion (4).

(Colorant Dispersion)

cyan pigment (trade name: ECB-301, manufactured by Dainichiseika Color & Chemicals Mfg. Co., Ltd.): 200 parts by weight anionic surfactant (trade name: Neogen SC, manufactured by Dai-ichi Kogyo Seiyaku Co., Ltd.): 20 parts by weight (as effective component, 10% by weight with respect to colorant)

ion-exchanged water: 780 parts by weight

In a stainless vessel having such a size that, when all of the above components are put therein, the liquid level becomes about a third of its height, 280 parts by weight of ion-exchanged water and 20 parts by weight of the anionic surfactant are put, and the surfactant is sufficiently dissolved. Next, the entire cyan pigment is put therein, stirring is conducted using a stirrer until the entire pigment gets wet, and defoaming is sufficiently conducted. After defoaming, remaining ion-exchanged water is added. Furthermore, dispersion is conducted at 5000 rpm for 10 minutes using a homogenizer (trade name: Ultra Turrax T-50, manufactured by IKA Japan K.K.), and stirring and defoaming are conducted using a stirrer for 24 hours.

After defoaming, dispersion is conducted again using the homogenizer at 6000 rpm for 10 minutes, and stirring and defoaming are conducted using the stirrer for 24 hours. Next, dispersion is conducted using a high-pressure impact type disperser Altimizer (trade name: HJP30006, manufactured by Sugino Machine Ltd.) at a pressure of 240 MPa. Dispersion is conducted by the amount corresponding to 25 pass from the overall load and processing ability of the apparatus. The resultant dispersion is left for 72 hours, and a supernatant liquid is extracted. Next, ion-exchanged water is added, and the concentration of the solid component is adjusted to 15% by weight. In this colorant dispersion, the volume-average particle diameter D50 of the particle is 115 nm. Moreover, the volume-average particle diameter D50 is obtained using an average value of the three measurement values, excluding the maximum and minimum, from the five measurement values by Microtrack.

(Releasing Agent Dispersion)

- polyalkylene wax (trade name: HNP-9, manufactured by Nippon Seiro Co., Ltd., melting temperature 78° C., and viscosity 2.5 mPa·s at 180° C.): 270 parts by weight
- anionic surfactant (trade name: Neogen RK, manufactured by Dai-ichi Kogyo Seiyaku Co., Ltd.): 8.4 parts by weight (as effective component, 3.0% by weight with respect to releasing agent)
- ion-exchanged water: 721.6 parts by weight The above components are mixed and dispersed by a homogenizer (trade name: Ultra Turrax T-50, manufactured by IKA Japan K.K.) while heating at 95° C. Next, dispersion is conducted using a pressure discharge type homogenizer (trade name: Gaulin homogenizer, manufactured by A. P. V. Gaulin Inc.), thereby obtaining a releasing agent dispersion. In this dispersion, the volume-average particle diameter D50 of the particle is 225 nm. Subsequently, ion-exchanged water is added to adjust the concentration of the solid component to 20.0% by weight.

Example 1

(Toner Production)

- ion-exchanged water: 254 parts by weight
- amorphous polyester resin dispersion (1): 380 parts by weight
- crystalline polyester resin dispersion (1): 44.8 parts by weight
- anionic surfactant (trade name: Neogen RK, manufactured by Dai-ichi Kogyo Seiyaku Co., Ltd., the amount of effective component 60% by weight): 2.5 parts by weight
- colorant dispersion: 60.5 parts by weight
- releasing agent dispersion: 61.8 parts by weight The above components are put in a 3 L reaction vessel, which includes a thermometer, a pH meter, and a stirrer, 1.0% by weight of a nitric acid aqueous solution is added, and pH is adjusted to 3.0.

Next, while dispersion is conducted at 5000 rpm using a homogenizer (trade name: Ultra Turrax T-50, manufactured by IKA Japan K.K.), 1.0% by weight of an ammonium sulfate aqueous solution is added in an amount of 75 parts by weight. Then, dispersion is conducted for 6 minutes while paying attention to avoid bubble entrainment. Subsequently, a stirrer and a mantle heater are provided in the reaction vessel, and temperature is increased to 35° C. at a rate of 0.1° C./minute while the number of rotations of the stirrer is adjusted such that slurry is sufficiently stirred, and then the temperature is held at 35° C. for 15 minutes. Next, while the temperature is increased at a rage of 0.05° C./minute, the particle diameter is measured using Multisizer II (manufactured by Beckman Coulter Inc., the aperture diameter: 50 μm) for every 10 minutes. If the volume-average particle diameter becomes 5.0 μm, the entire previously prepared addition particle dispersion (1) is put within 3 minutes, and then is left for 30 minutes. Thereafter, pH is set to 9.0 using 5% by weight of sodium hydroxide solution. Subsequently, while pH is adjusted to 9.0 for every 5° C., the temperature is increased to 90° C. at a rate of 1° C./minute and held at 90° C. Observation of the particle shape and surface property is conducted by an optical microscope and a scanning electron microscope (FE-SEM) for every 30 minutes. Coalescence of the particles is observed in an hour, and then the vessel is cooled to 30° C. by cooling water.

After cooling, the slurry is sieved with a 20 μm mesh to remove coarse powder, a reactive product is filtered with an aspirator under reduced pressure, and flow washing is conducted using ion-exchanged water. If conductivity of the filtrate is 50 mS or less, a cake-shaped particle is extracted and put in ion-exchanged water having a weight ten times as large as the weight of the particle. Next, stirring is conducted by Three-one motor until the particles get sufficiently loose. Next, pH is adjusted to 3.8 using 1.0% by weight of nitric acid aqueous solution and left for 30 minutes. Thereafter, filtering and flow washing are conducted again. If conductivity of the filtrate becomes less than 10 mS, flow washing stops and solid-liquid separation is conducted. The separated cake-shaped particle is vacuum-dried in an oven at 40° C. for 24 hours, and the resultant powder is disintegrated by a sample mill, and then vacuum-dried in an oven at 40° C. for 5 hours, thereby obtaining toner particles.

1.0 parts by weight of hydrophobic silica (trade name: RY50, manufactured by Nippon Aerosil Co., Ltd.) and 0.8 parts by weight of hydrophobic titanium oxide (trade name: T805, manufactured by Nippon Aerosil Co., Ltd.) are added to 100 parts by weight of the resultant toner particles, and blending is conducted using a sample mill at 13000 rpm for 30 seconds. Thereafter, the mixture is sieved with a vibration sieve having 45 μm mesh, thereby obtaining a toner (1).

(Electrostatic Image Developer and Supply Developer Preparation)

- ferrite particle (volume-average particle diameter: 35 μm): 500 parts by weight
- toluene: 70 parts by weight
- perfluorooctylethylmethacrylate/methacrylate copolymer (copolymerization ratio: 15/85, Mw: 73000): 10 parts by weight
- carbon black (trade name: VXC72, manufactured by Cabot Corp.): 1.0 part by weight First, the components excluding the ferrite particle are mixed, and stirred by a sand mill for 10 minutes, thereby preparing a coating liquid including dispersed carbon black. Next, the coating liquid and the ferrite particle are put in a vacuum deaeration type kneader, and are mixed for 30 minutes in a state the pressure is reduced to $9.87\times10^4$ Pa at 60° C. during stirring. Next, the temperature is increased to 90° C. and the pressure is reduced to $5.33\times10^3$ Pa. Next, stirring and drying is conducted at 90° C. and $5.33\times10^3$ Pa for 30 minutes, thereby obtaining a carrier.

40 parts by weight of the toner is added to 500 parts by weight of the carrier, and blended using a V-type blender for 20 minutes. Then, an aggregate is removed with a vibration sieve having a 212 μm mesh. As a result, a developer (1) is obtained.

100 parts by weight of the toner is added to 20 parts by weight of the carrier, and blended using a V-type blender for 20 minutes. Then, an aggregate is removed with a vibration sieve having a 212 μm mesh. As a result, a supply developer (1) is obtained.

(Evaluation)

-Toner Analysis and Characteristic-

Content of Tin in Amorphous Resin and Content of Titanium in Crystalline Resin

As a result of elemental analysis using ICP spectroanalysis by the above-described method, the content of titanium is 100 ppm, and the content of tin is 700 ppm.

Endothermic Quantity by DSC 8 mg of the toner is prepared as a sample, and set on a differential scanning calorimeter (trade name: DSC-50, manufactured by Shimadzu Corporation). DSC measurement is conducted under the above-described conditions, and thus ΔH1 and ΔH2 are obtained. As a result, ΔH1 is 41 J/g, and ΔH2 is 11 J/g.

(Practical Characteristic)

In an environment at temperature of 33° C. and relative humidity 75%, the developer (1) is set in a developing unit of DocuCentre Color 400 (manufactured by Fuji Xerox Co., Ltd.), and the supply developer (1) is set in a toner cartridge. In addition, the amount of a developing toner for each monochrome solid image on a paper is adjusted to 4.5 g/m$^2$. Here, the same developer (1) is set in the developing units for cyan, magenta, and yellow. Accordingly, an output image is actually a laminated image of the same cyan toner for tertiary colors, not a color image.

Gloss Stability

While 100 sheets of C2r paper having A3 size (manufactured by Fuji Xerox Office Supply) pass by, the toner is charged and compulsory deteriorated. Next, while forming a laminated image according to third color having a size of 10 cm square at the center of the paper using mirror coat gold 256 g/m$^2$ (manufactured by Fuji Xerox Office Supply), one sheet of image is output at a process speed of 50 mm/second, and then image gloss is measured. Next, under the same condition, 70 sheets are successively output. After the successive output, the sheets are left for 10 minutes until the sheets are cooled. Measurement is conducted for image gloss of the 50th sheet. Then, image gloss stability is evaluated according to the following criteria by a gloss difference between image gloss when one sheet is output and image gloss of the 50th sheet when successive output.

A: Gloss Difference is less than 3

B: Gloss Difference is 3 or more and less than 5

C: Gloss Difference is 5 or more

Moreover, measurement of image gloss is conducted using a 60-degree gloss meter (manufactured by BYK Gardner). Measurement is conducted at five points including the center of the image and four points distant from the center toward four corners by 2.5 cm, and the average of the five measurement values is set as the gloss value (glossiness). The results are shown in Table 1.

Image Quality

When 70 sheets are successively printed, evaluation is visually conducted on the 50th output image according to the following criteria in view of image quality, such as gloss irregularity.

A: No gloss irregularity in solid part and no effect on entire image.

B: Gloss irregularity is slightly observed in solid part, but no damage occurs in image (no practical problem).

C: Gloss irregularity is observed in solid part, and edge of image is damaged.

The results are shown in Table 1.

Example 2

A toner (2) and a developer (2) are prepared in the same manner as in the toner production of Example 1, except that the amorphous polyester dispersion (1) is substituted with an amorphous polyester resin dispersion (3), and the addition particle dispersion (1) is substituted with an addition particle dispersion (3). Evaluation is performed in the same manner as in Example 1.

The results are shown in Table 1.

Example 3

A toner (3) and a developer (3) are prepared in the same manner as in the toner production of Example 1, except that the crystalline polyester dispersion (1) is substituted with a crystalline polyester resin dispersion (3). Evaluation is performed in the same manner as in Example 1.

The results are shown in Table 1.

Example 4

A toner (4) and a developer (4) are prepared in the same manner as in the toner production of Example 1, except that the amorphous polyester dispersion (1) is substituted with an amorphous polyester resin dispersion (4), and the addition particle dispersion (1) is substituted with an addition particle dispersion (4). Evaluation is performed in the same manner as in the Example 1.

The results are shown in Table 1.

Comparative Example 1

A toner (5) and a developer (5) are prepared in the same manner as in the toner production of Example 1, except that, the amorphous polyester resin dispersion (1) is substituted with an amorphous polyester resin dispersion (2), and the addition particle dispersion (1) is substituted with an addition particle dispersion (2). Evaluation is performed in the same manner as in Example 1.

The results are shown in Table 1.

Comparative Example 2

A toner (6) and a developer (6) are prepared in the same manner as in the toner production of Example 1, except that the crystalline polyester dispersion (1) is substituted with a crystalline polyester resin dispersion (2). Evaluation is performed in the same manner as in Example 1.

The results are shown in Table 1.

TABLE 1

| | Toner (developer) | Acid value of resin (mgKOH/g) Crystalline resin | Acid value of resin (mgKOH/g) Amorphous resin | Mainly used catalyst Crystalline resin part | Mainly used catalyst Amorphous resin part | Content of chloroform-soluble component (ppm) Ti | Content of chloroform-soluble component (ppm) Sn | Practical characteristic Gloss difference | Practical characteristic Image quality |
|---|---|---|---|---|---|---|---|---|---|
| Example 1 | (1) | 9.8 | 14 | Ti | Sn | 100 | 700 | 1.5(A) | A |
| Example 2 | (2) | 9.8 | 9.1 | Ti | Sn | 100 | 500 | 3.1(B) | A |
| Example 3 | (3) | 10.6 | 14 | Ti | Sn | 600 | 700 | 2.8(A) | B |
| Example 4 | (4) | 9.8 | 16.2 | Ti | Sn | 100 | 1600 | 3.6(B) | A |
| Comparative example 1 | (5) | 9.8 | 15 | Ti | Ti | 100 | 250 | 4.6(B) | C |
| Comparative example 2 | (6) | 8.9 | 14 | Sn | Sn | 600 | 700 | 5.3(C) | B |

As will be apparent from Examples in Table 1, when a toner containing crystalline polyester resin polymerized using a titanium-containing catalyst and amorphous polyester resin polymerized using a tin-containing catalyst as binder resin is used, under an adverse condition to solidification, it can be seen that image glossiness is not considerably changed, and stable image quality is obtained under various fixing conditions.

Meanwhile, in Comparative Examples, in which the composition of the binder resin is different, glossiness may be changed, or image quality may be deteriorated.

What is claimed is:

1. An electrostatic image developing toner comprising a colorant, a releasing agent, and a binder resin containing an amorphous polyester resin and a crystalline polyester resin, the amorphous polyester resin containing a component derived from n-dodecenylsuccinic acid and a tin-containing catalyst, and the crystalline polyester resin containing a titanium-containing catalyst, wherein a content of amorphous polyester resin in the binder resin is in a range of from about 86 to about 98% by weight, acid values of the amorphous polyester resin and the crystalline polyester resin are in a range of from greater than 7 mgKOH/g to less than 25 mgKOH/g, the acid value of the amorphous polyester resin being greater than the acid value of the crystalline polyester resin, and the electrostatic image developing toner is produced by forming aggregate particles by aggregation of particles of the amorphous polyester resin, particles of the crystalline polyester resin, particles of the colorant and particles of the releasing agent, and further adhering addition particles to the aggregate particles, the addition particles comprising the amorphous polyester resin.

2. The electrostatic image developing toner of claim 1, wherein a content of titanium in a crystalline resin component of chloroform-soluble components of the toner is in a range of from 10 ppm to 500 ppm according to high-frequency inductively coupled plasma emission spectrometry, and a content of tin in an amorphous resin component of chloroform-soluble components of the toner is in a range of from 50 ppm to 1500 ppm according to high-frequency inductively coupled plasma emission spectrometry.

3. An electrostatic image developer comprising the electrostatic image developing toner according to claim 1.

* * * * *